US010539295B2

(12) United States Patent
Kim et al.

(10) Patent No.: US 10,539,295 B2
(45) Date of Patent: Jan. 21, 2020

(54) LIGHTING DEVICE

(71) Applicant: LG INNOTEK CO., LTD., Seoul (KR)

(72) Inventors: Jin Wook Kim, Seoul (KR); Ki Woong Kim, Seoul (KR); Young Sik Kim, Seoul (KR); Chang Hyuk Im, Seoul (KR); Sang Jun Hong, Seoul (KR); Ji Hwan Jeon, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 499 days.

(21) Appl. No.: 15/024,684

(22) PCT Filed: Sep. 23, 2014

(86) PCT No.: PCT/KR2014/008810
§ 371 (c)(1),
(2) Date: Mar. 24, 2016

(87) PCT Pub. No.: WO2015/046850
PCT Pub. Date: Apr. 2, 2015

(65) Prior Publication Data

US 2016/0230937 A1 Aug. 11, 2016

(30) Foreign Application Priority Data

Sep. 24, 2013 (KR) ..... 10-2013-0112970

(51) Int. Cl.
*F21V 7/04* (2006.01)
*F21V 19/04* (2006.01)
(Continued)

(52) U.S. Cl.
CPC ..... *F21V 7/04* (2013.01); *F21K 9/235* (2016.08); *F21K 9/238* (2016.08); *F21V 17/06* (2013.01);
(Continued)

(58) Field of Classification Search
CPC . F21V 7/04; F21V 29/15; F21V 17/06; F21V 19/04; F21V 21/04; F21V 21/088;
(Continued)

(56) References Cited

U.S. PATENT DOCUMENTS 5,826,970 A * 10/1998 Keller ..... F21S 8/02 362/147
5,836,677 A * 11/1998 Connors ..... F21S 8/02 362/304
(Continued)

FOREIGN PATENT DOCUMENTS

CN 202419237 U 9/2012
CN 102937275 A 2/2013
(Continued)

*Primary Examiner* — Bryon T Gyllstrom
(74) *Attorney, Agent, or Firm* — Birch, Stewart, Kolasch & Birch, LLP

(57) ABSTRACT

The disclosure relates to a lighting device. The lighting device includes a body including a side wall and a base disposed on the side wall; a light source which is disposed below the base of the body; a power supply which is disposed on the base of the body to supply a power to the light source; and a clip including a connection portion and an extension portion extending from the connection portion and disposed on the side wall of the body, wherein the extension portion of the clip has at least one bent portion which is bent toward the side wall of the body.

9 Claims, 25 Drawing Sheets

(51) Int. Cl.

| | |
|---|---|
| ***F21V 21/04*** | (2006.01) |
| ***F21V 29/15*** | (2015.01) |
| ***F21V 23/00*** | (2015.01) |
| ***F21K 9/235*** | (2016.01) |
| ***F21K 9/238*** | (2016.01) |
| ***F21V 17/06*** | (2006.01) |
| ***F21V 21/088*** | (2006.01) |
| ***F21V 23/02*** | (2006.01) |
| ***F21V 23/06*** | (2006.01) |
| ***F21Y 115/10*** | (2016.01) |
| ***F21Y 105/10*** | (2016.01) |

(52) U.S. Cl.

CPC ..... *F21V 19/04* (2013.01); *F21V 21/04* (2013.01); *F21V 21/088* (2013.01); *F21V 23/006* (2013.01); *F21V 23/02* (2013.01); *F21V 23/06* (2013.01); *F21V 29/15* (2015.01); *F21Y 2105/10* (2016.08); *F21Y 2115/10* (2016.08)

(58) Field of Classification Search

CPC ..... F21V 23/006; F21V 23/02; F21V 23/06; F21K 9/238; F21K 9/235

USPC ..... 362/307

See application file for complete search history.

(56) References Cited

U.S. PATENT DOCUMENTS

| | | | | |
|---|---|---|---|---|
| 8,072,123 | B1 * | 12/2011 | Han | F21K 9/23 313/45 |
| 9,151,457 | B2 * | 10/2015 | Pickard | F21S 8/026 |
| 2005/0174765 | A1 * | 8/2005 | Dorleijn | F21V 19/0095 362/217.17 |
| 2006/0091272 | A1 * | 5/2006 | Piel | F16B 13/0808 248/231.9 |
| 2011/0267826 | A1 | 11/2011 | Santiago et al. | |
| 2012/0127731 | A1 * | 5/2012 | Masuda | F21S 8/026 362/341 |
| 2012/0182744 | A1 * | 7/2012 | Santiago | F21S 8/026 362/365 |
| 2013/0016516 | A1 * | 1/2013 | Trott | F21S 8/026 362/365 |
| 2013/0265750 | A1 * | 10/2013 | Pickard | F21V 21/088 362/184 |

FOREIGN PATENT DOCUMENTS

| | | | |
|---|---|---|---|
| JP | 2009-64781 | A | 3/2009 |
| JP | 2010-102913 | A | 5/2010 |
| JP | 2012-160332 | A | 8/2012 |
| KR | 20-2012-0006181 | U | 9/2012 |
| WO | WO 2011/083939 | A2 | 7/2011 |

* cited by examiner

【Fig. 1】
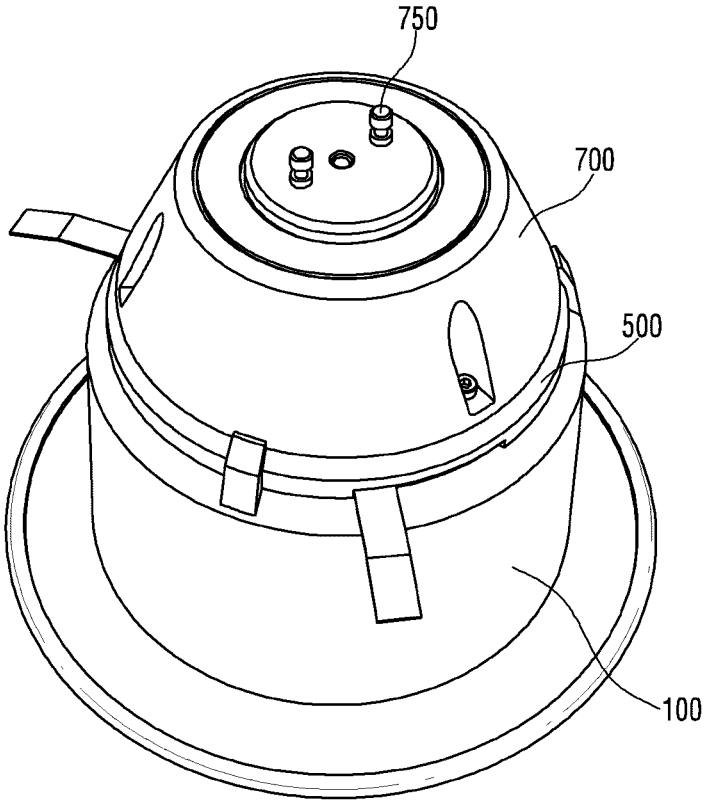

【Fig. 2】
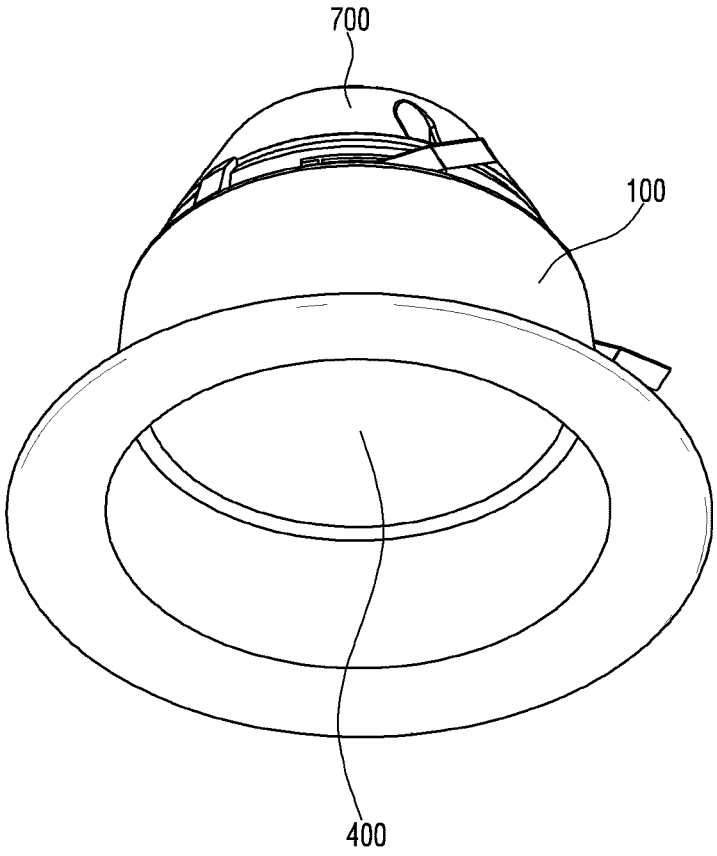

【Fig. 3】
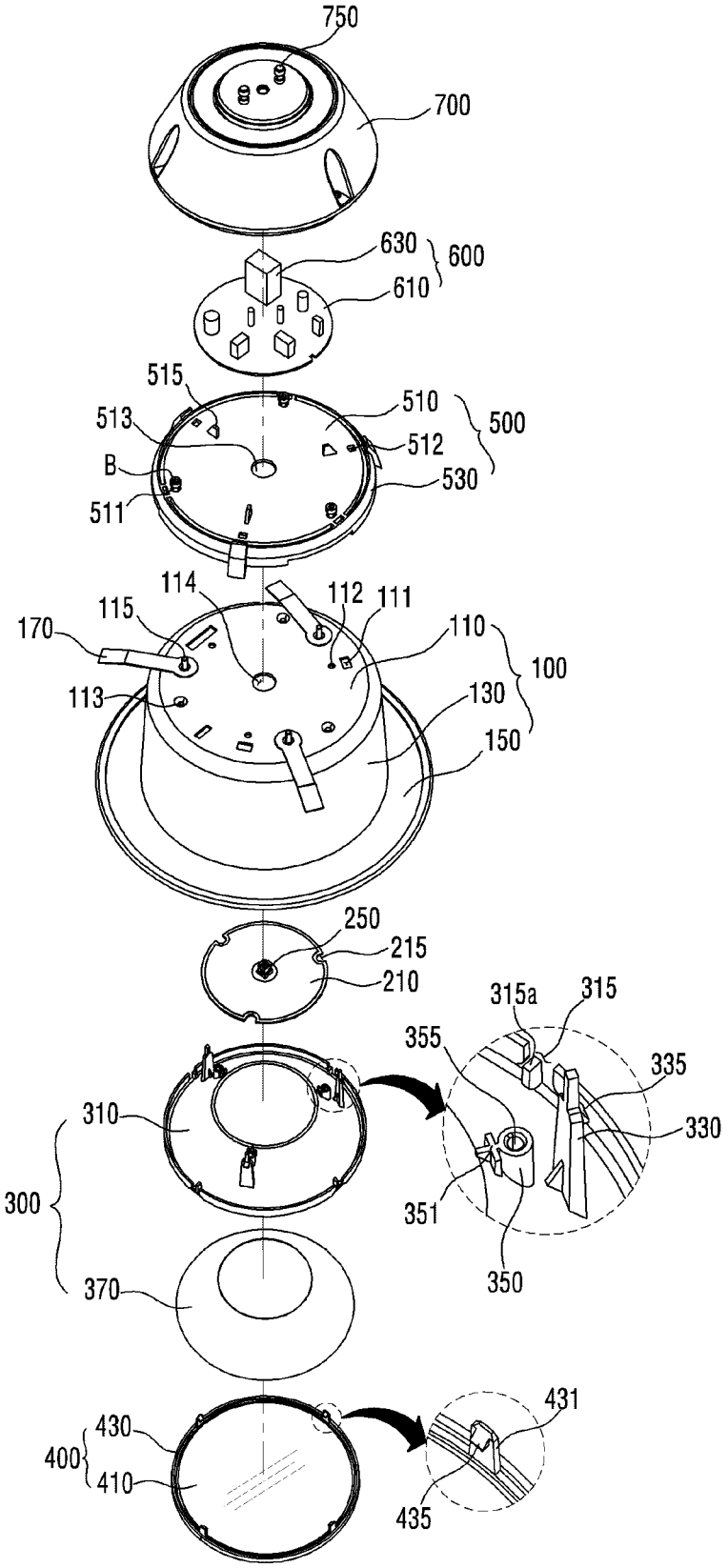

【Fig. 4】
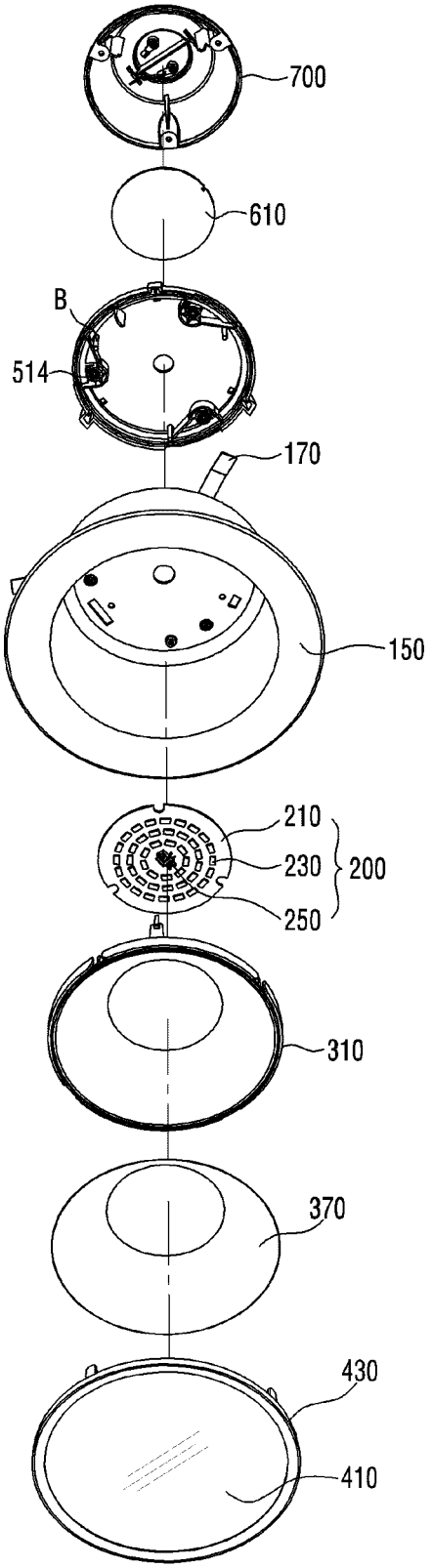

【Fig. 5】
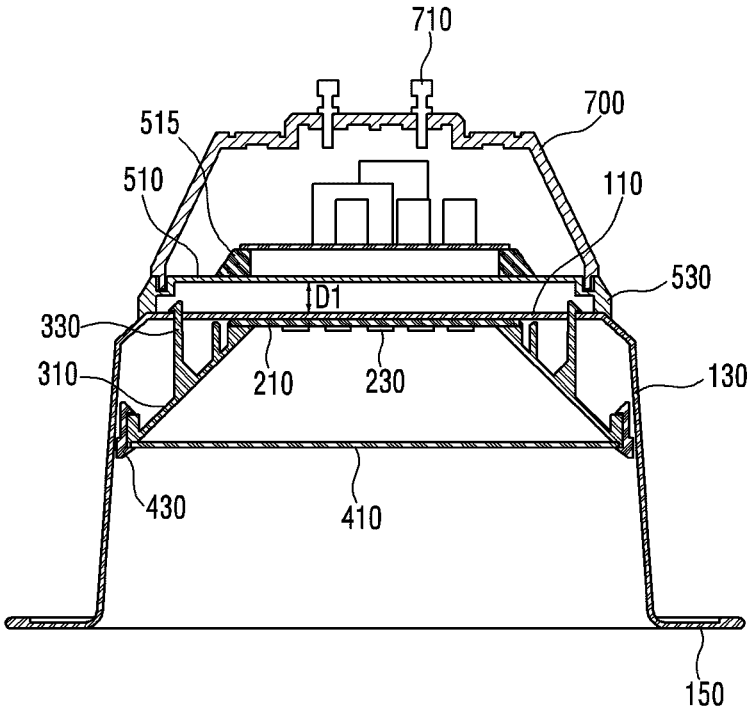
【Fig. 6】
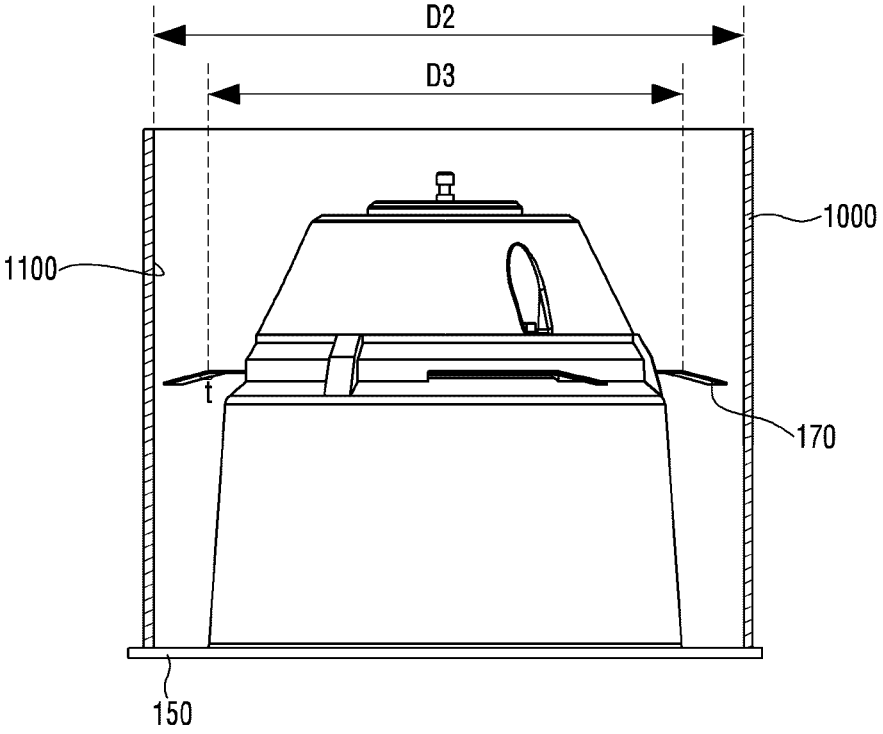

【Fig. 7】
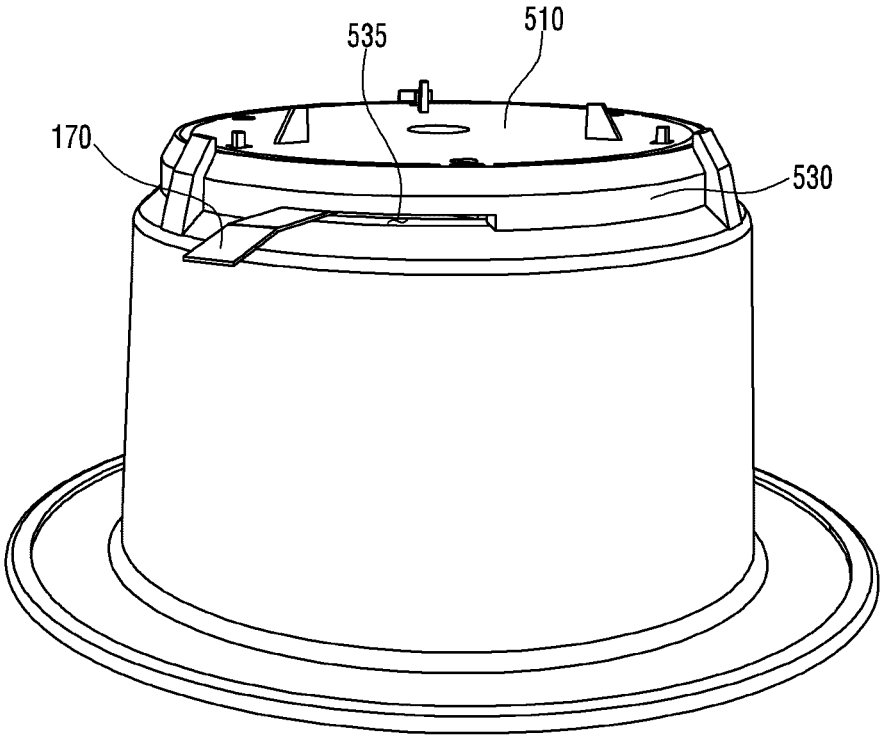
【Fig. 8】
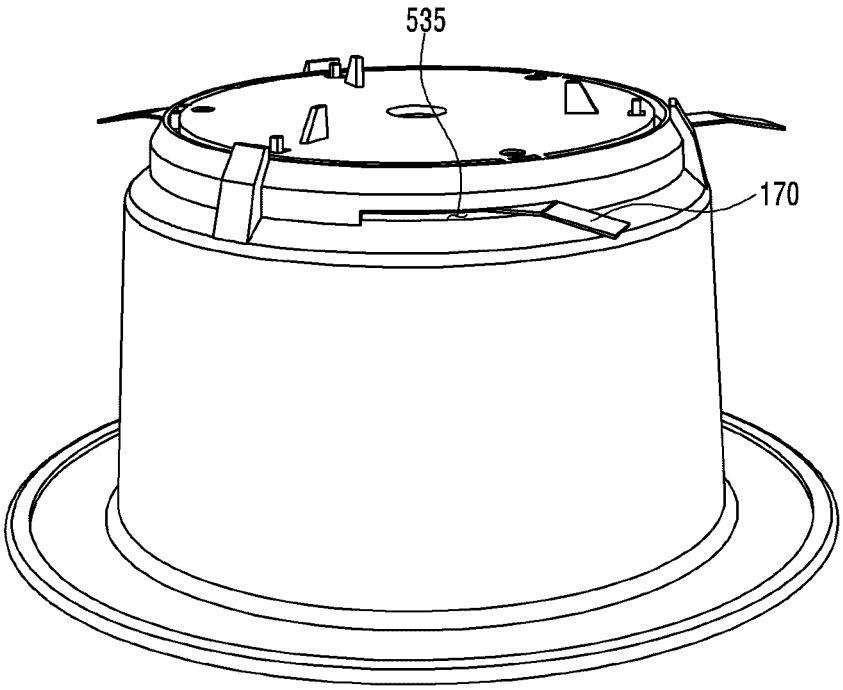

【Fig. 9】
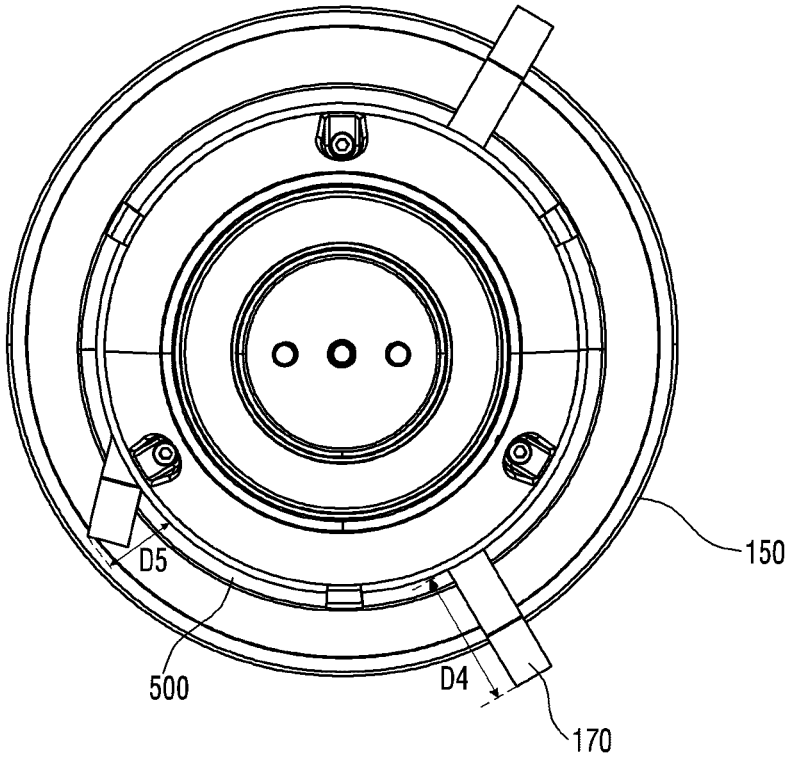
【Fig. 10】
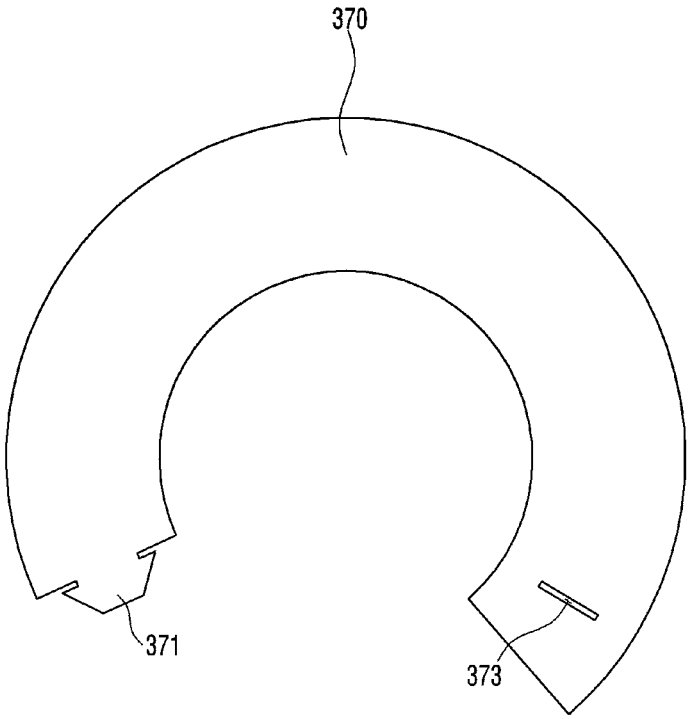

【Fig. 11】
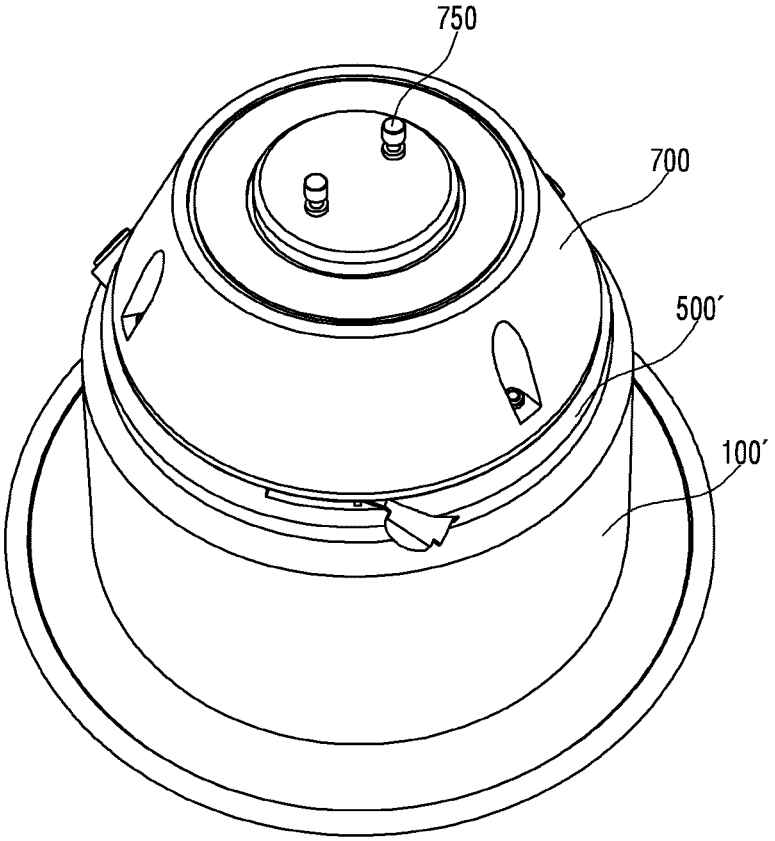

【Fig. 12】
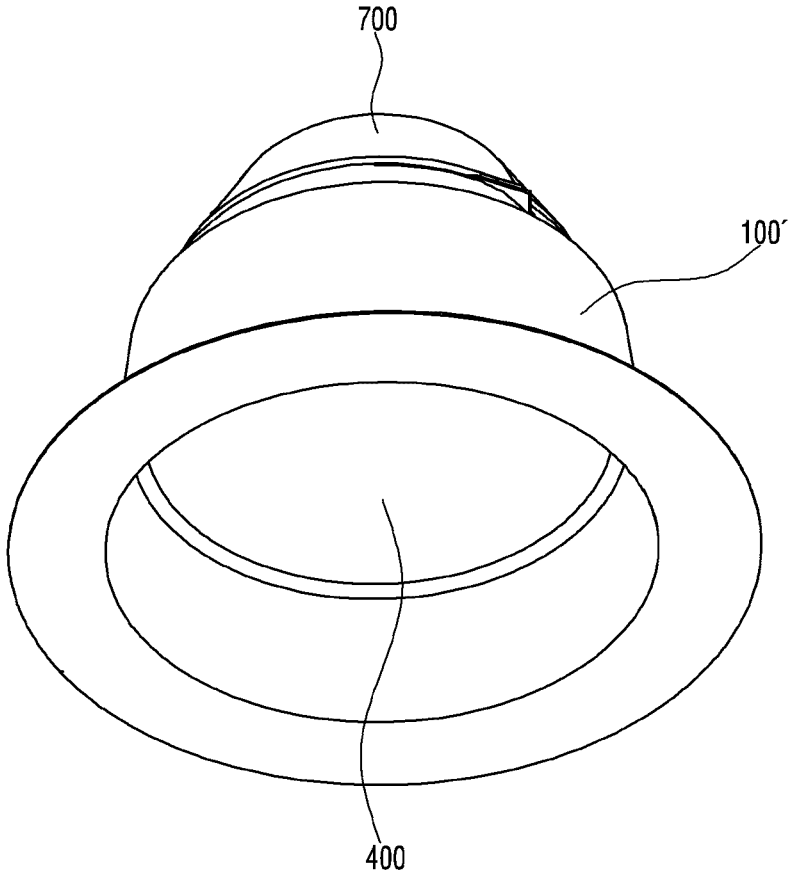

【Fig. 13】
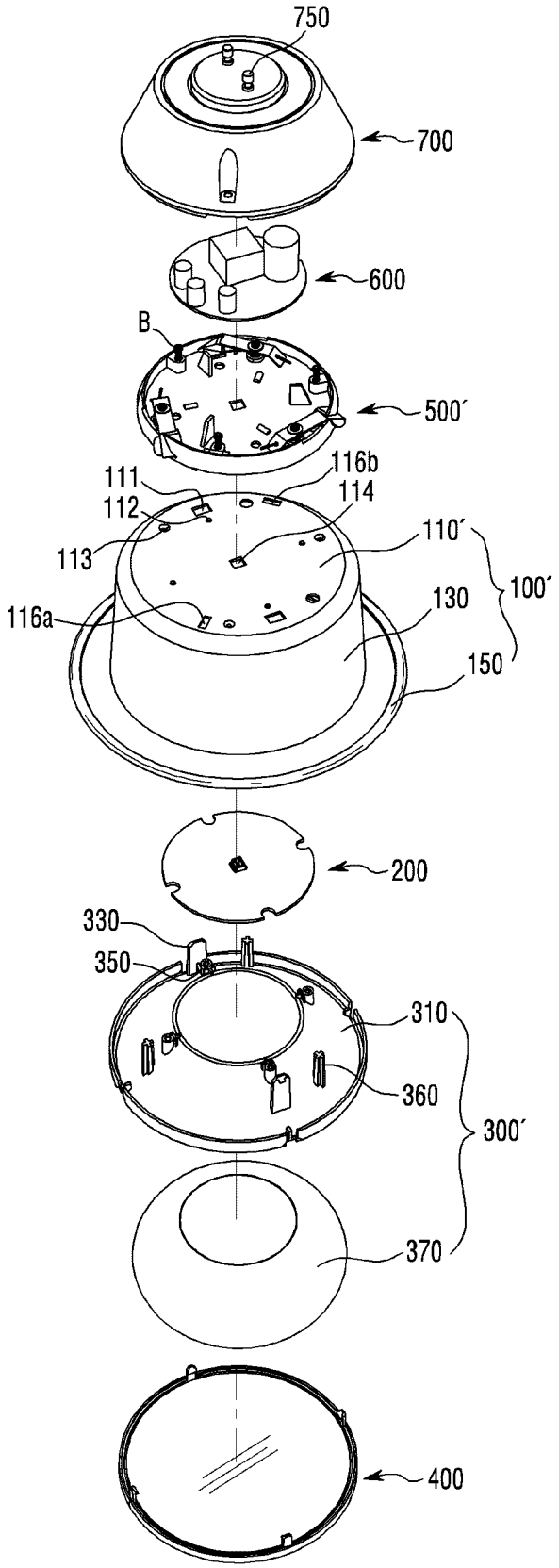

【Fig. 14】
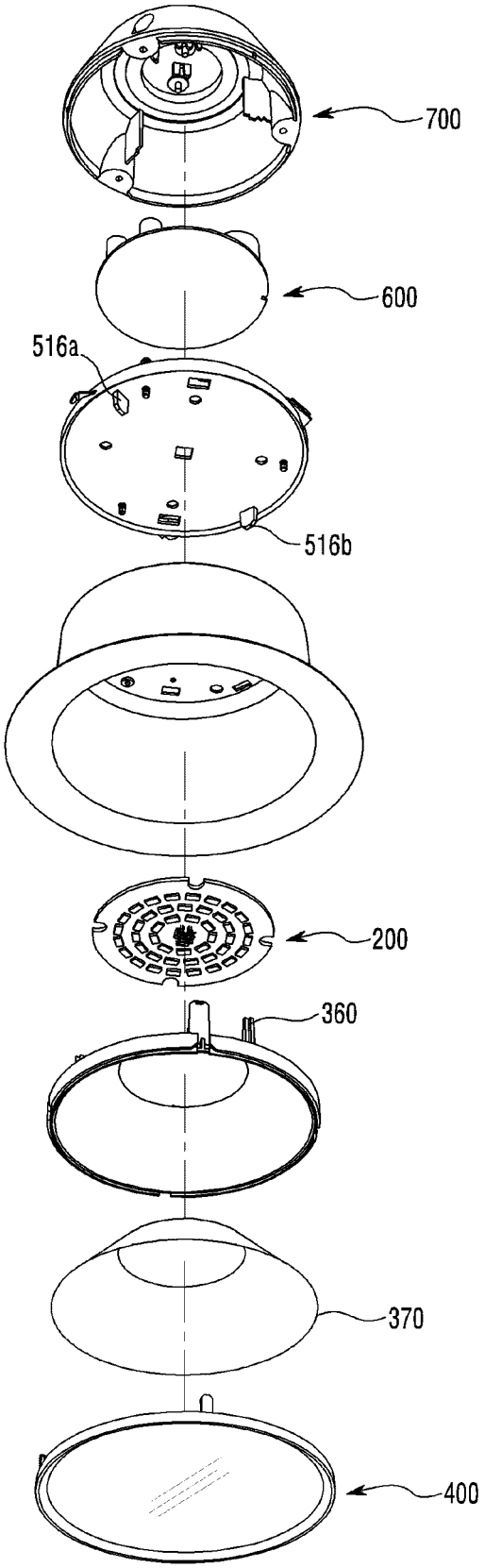

【Fig. 15】
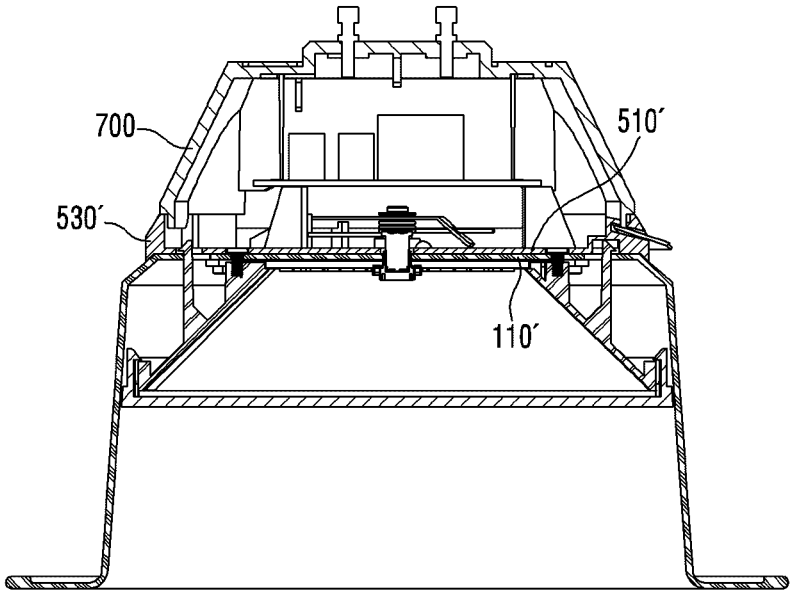

【Fig. 16】
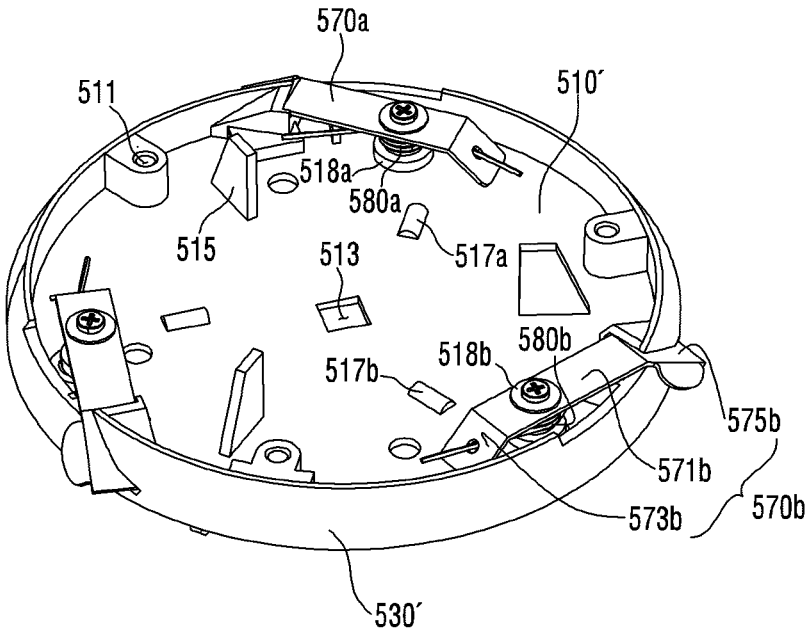
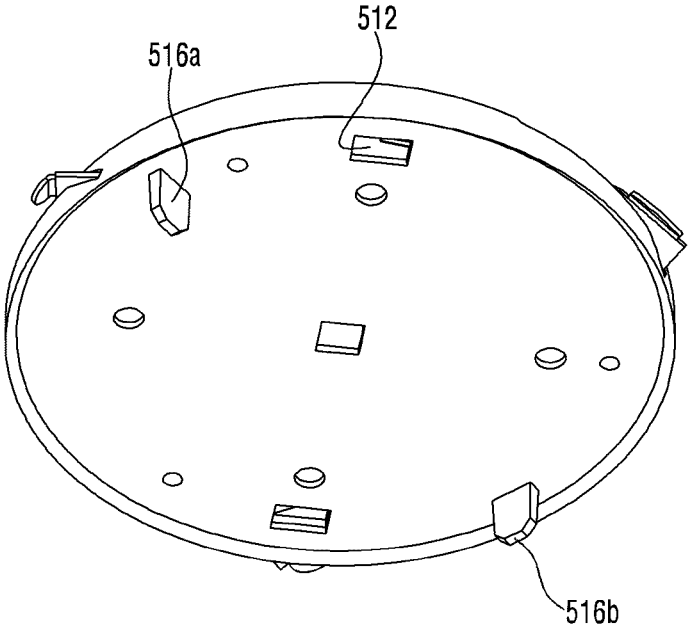

【Fig. 17】
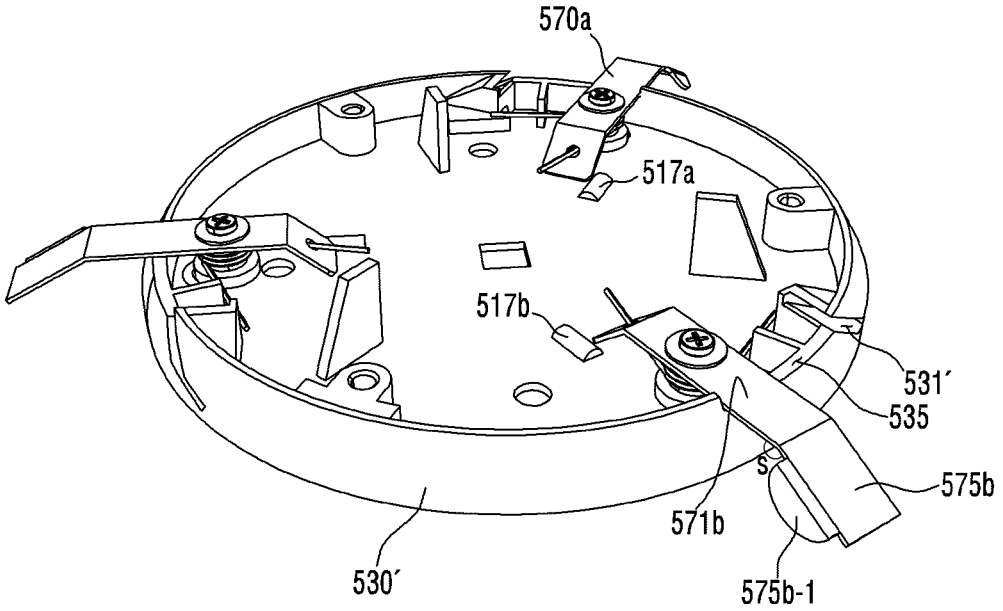
【Fig. 18】
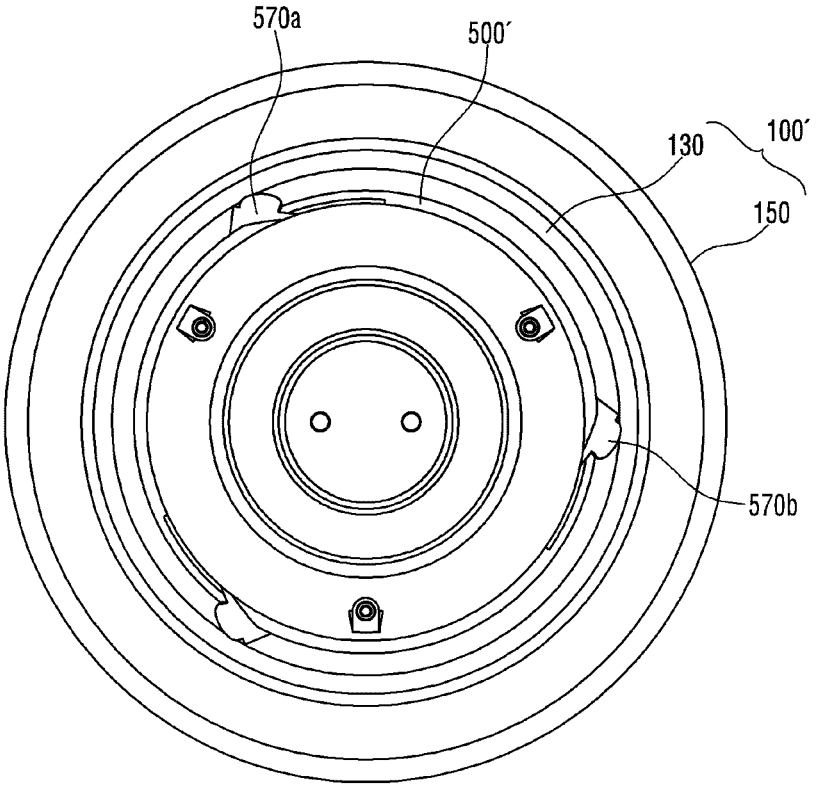

【Fig. 19】
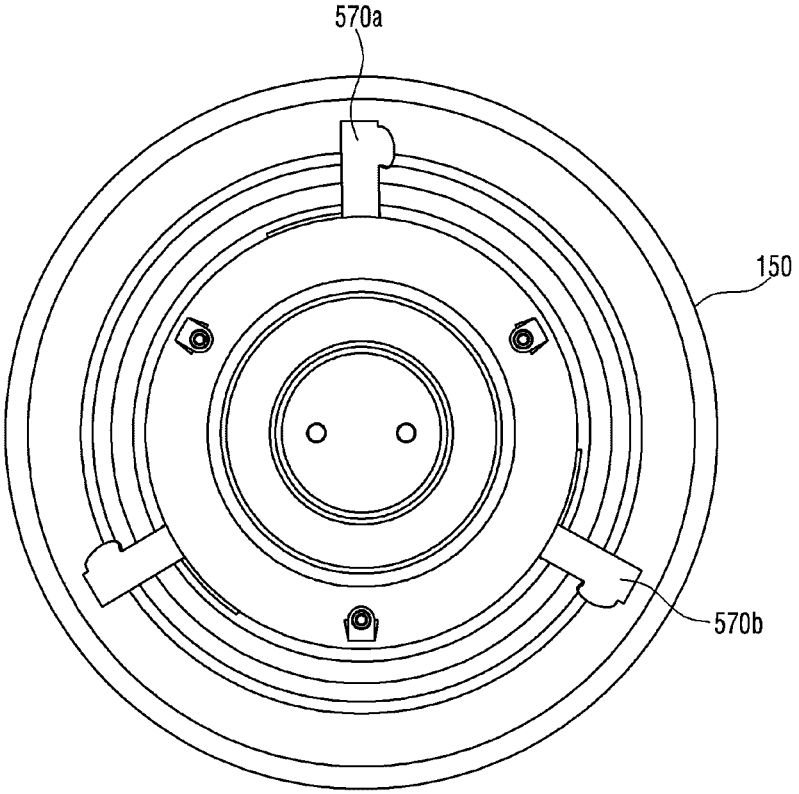

【Fig. 20】
500″
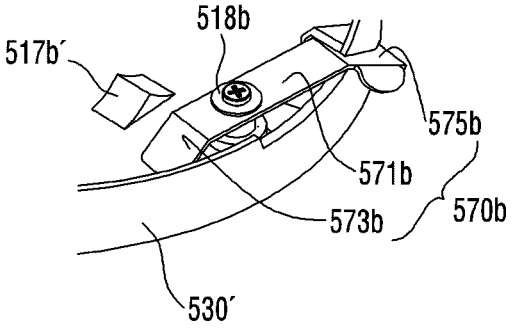
500″
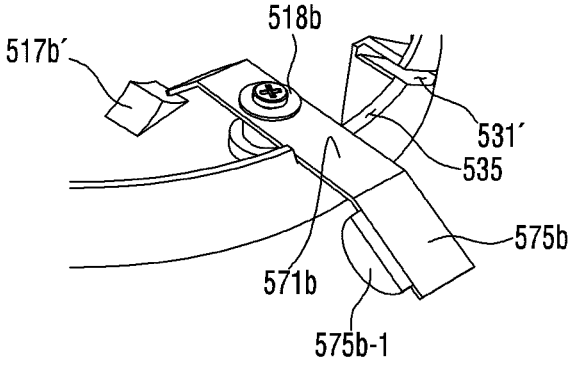

【Fig. 21】
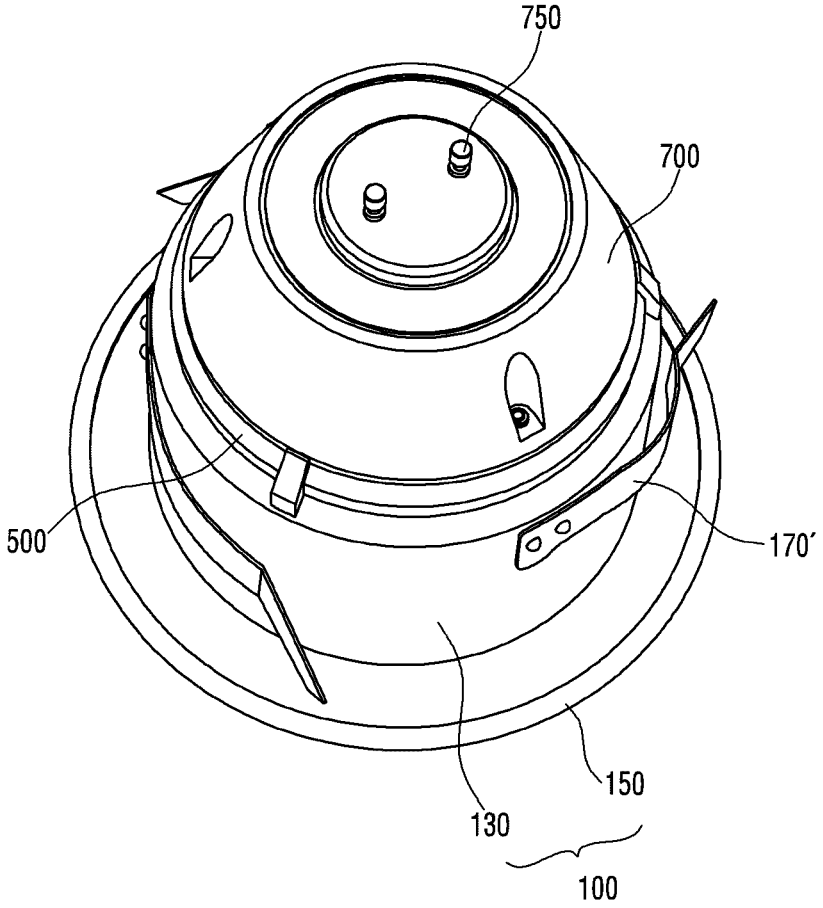

【Fig. 22】
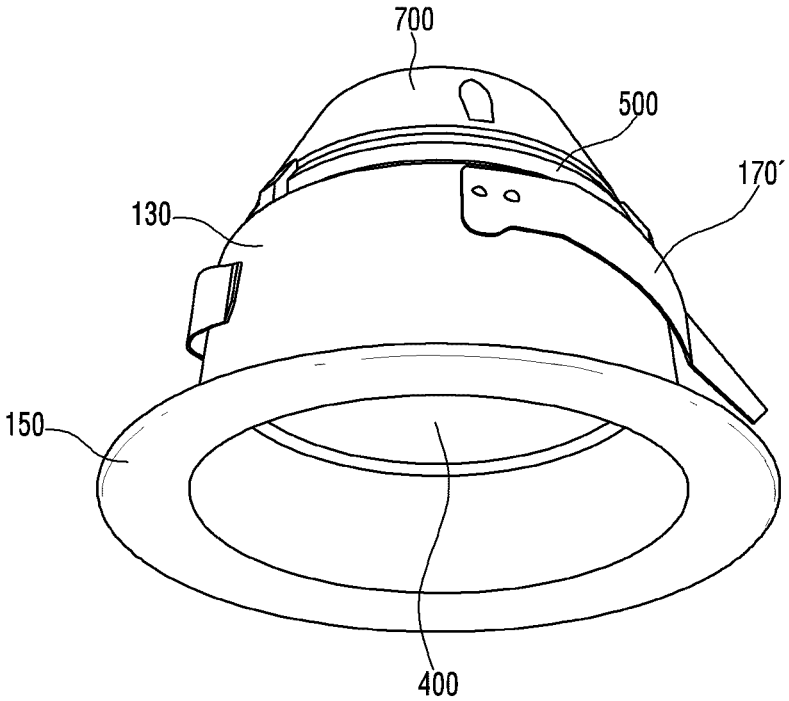

【Fig. 23】
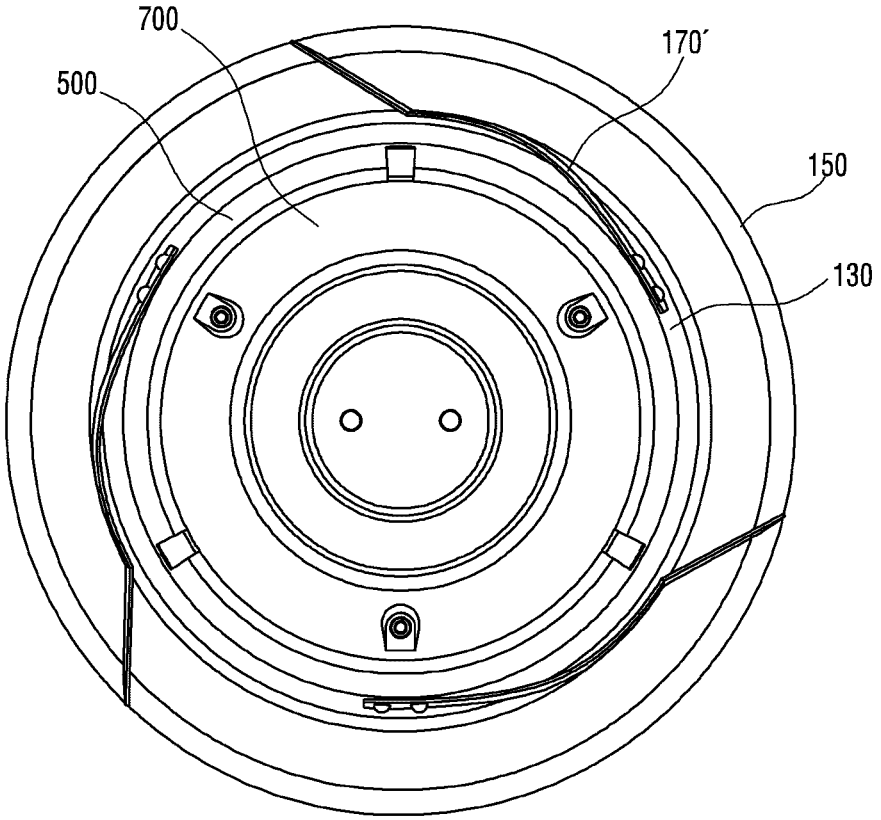
【Fig. 24】
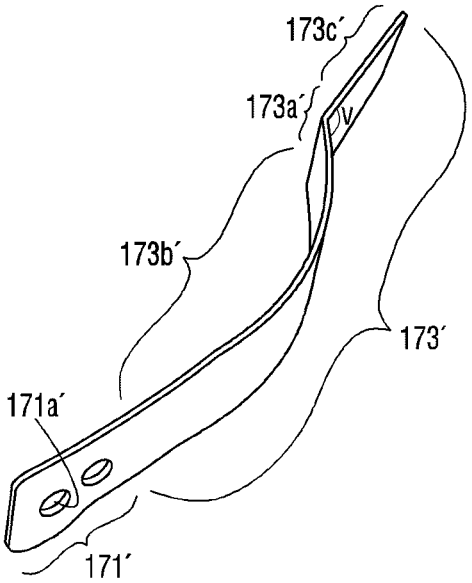

【Fig. 25】
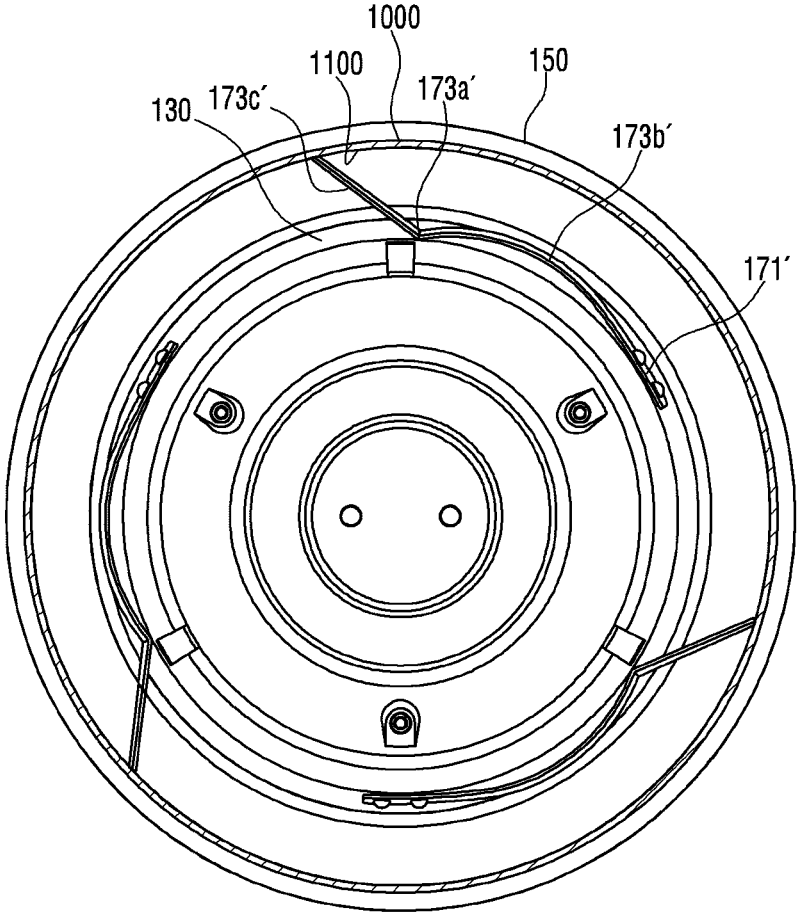

【Fig. 26】
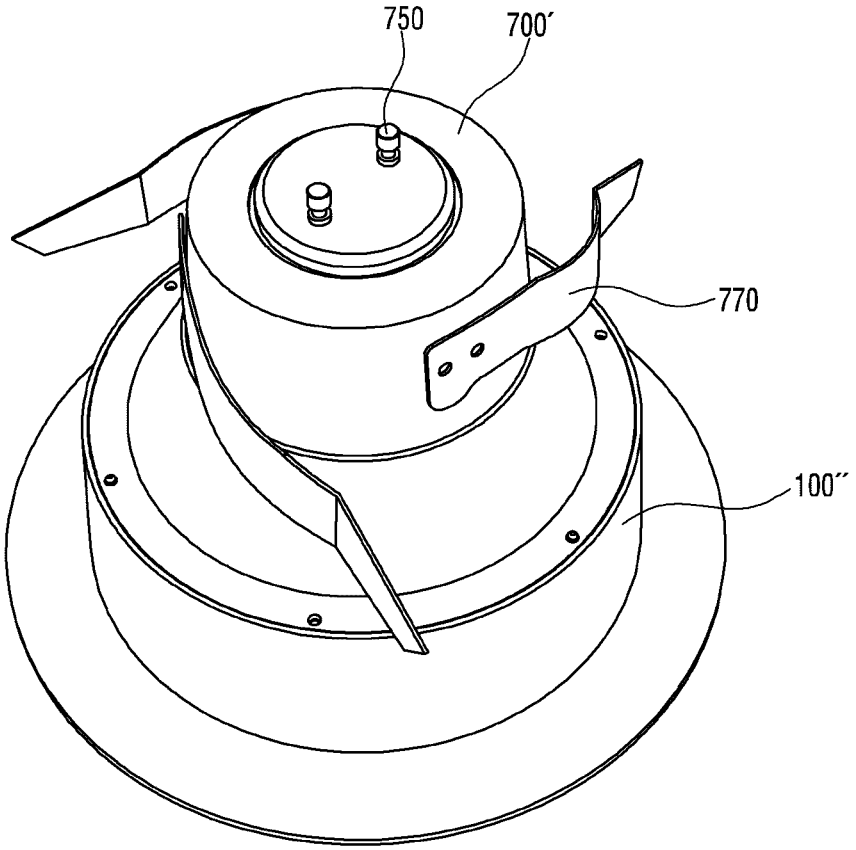

【Fig. 27】
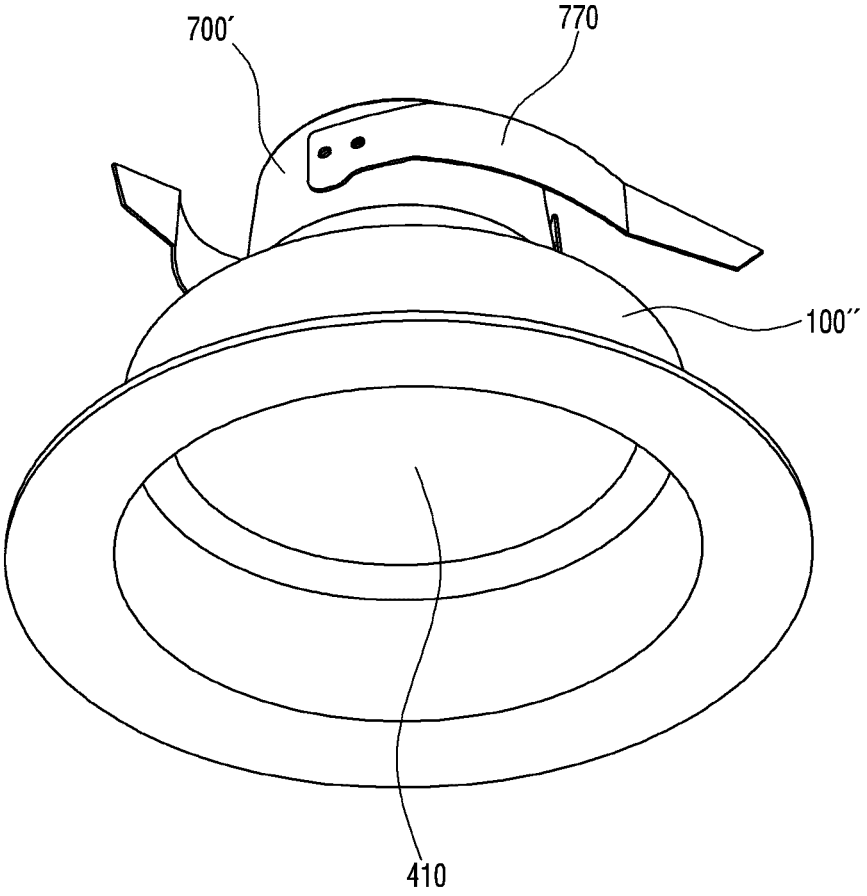

【Fig. 28】
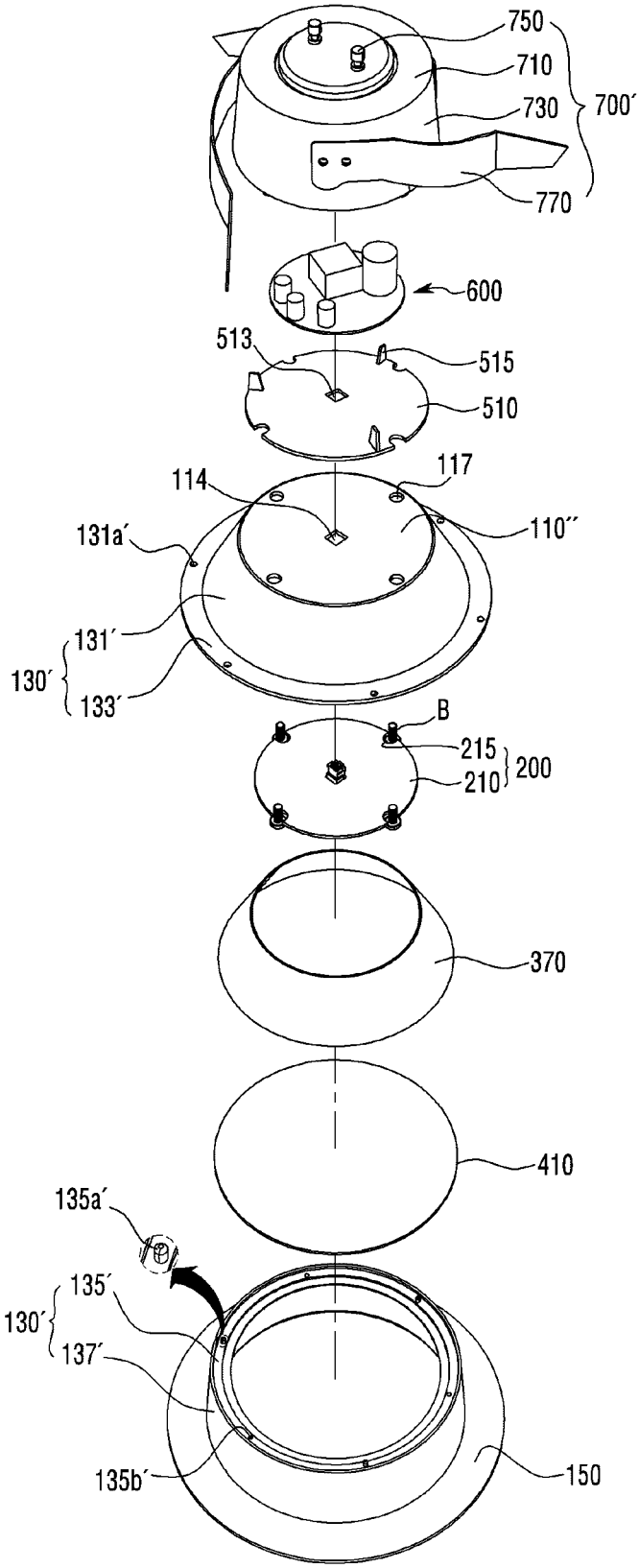

【Fig. 29】
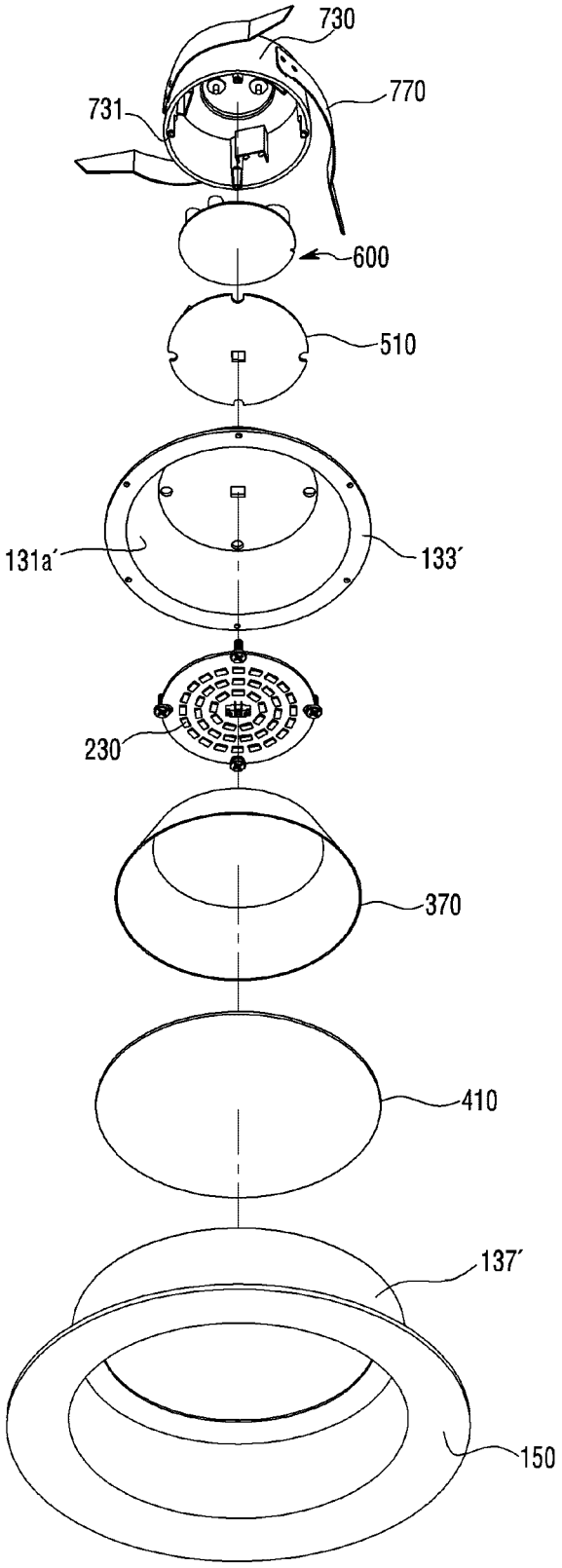

【Fig. 30】
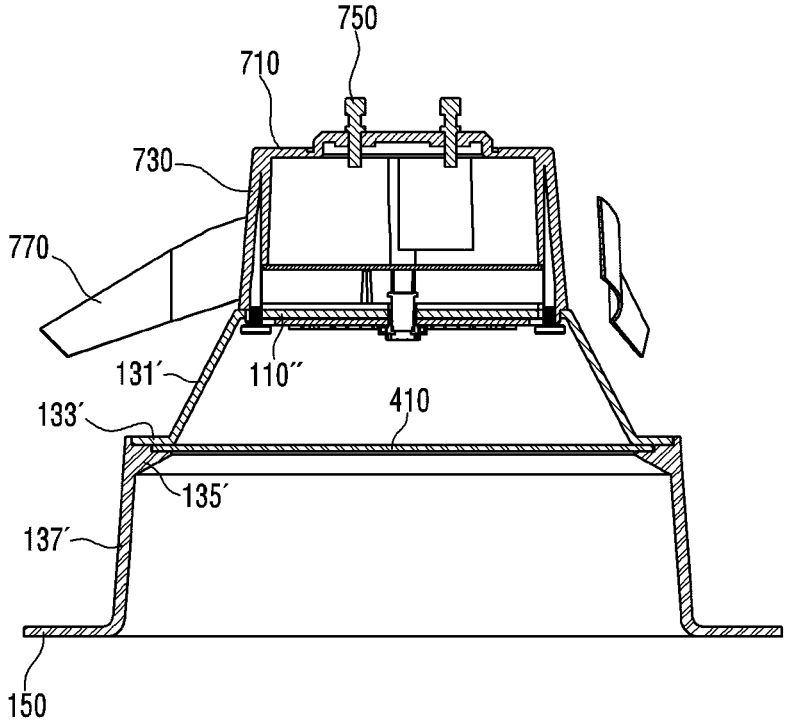

LIGHTING DEVICE

CROSS REFERENCE TO RELATED APPLICATIONS

This application is the National Phase of PCT International Application No. PCT/KR2014/008810, filed on Sep. 23, 2014, which claims priority under 35 U.S.C. 119(a) to Patent Application No. 10-2013-0112970, filed in Republic of Korea on Sep. 24, 2013, all of which are hereby expressly incorporated by reference into the present application.

TECHNICAL FIELD

The application relates to a lighting device.

BACKGROUND ART

A light emitting diode (LED) is a kind of a semiconductor device capable of converting electric energy into light. The light emitting diodes have many advantages over conventional light sources, such as a light bulb or a fluorescent light, including lower energy consumption, longer lifetime, faster response speed, improved safety, and better eco-friendly characteristic. A lot of studies have been conducted recently in order to replace the conventional light sources by the light emitting diodes. The light emitting diodes are increasingly used as a light source of various indoor/outdoor lighting devices, for example, lamps, liquid crystal devices, electronic display boards, or streetlamps.

DISCLOSURE

Technical Problem

Accordingly, the application provides a lighting device which can be stably fixed to an outer fixture.

Also, the application provides a lighting device which can be manufactured inexpensively by lowering material costs.

In addition, the application provides a lighting device which can be more stably fixed to an outer fixture.

Furthermore, the application provides a lighting device capable of reducing an influence of a light source to a power supply.

Still further, the application provides a lighting device which can be easily fixed to an outer fixture.

Furthermore, the application provides a lighting device capable of improving efficiency of light extraction.

Furthermore, the application provides a lighting device capable of reducing material costs.

Furthermore, the application provides a lighting device which can be easily detached from an outer fixture.

Furthermore, the application provides a lighting device capable of preventing negligent accident of a worker or user.

Furthermore, the application provides a lighting device capable of preventing an outer fixture from being damaged.

Furthermore, the application provides a lighting device which can be stably installed to an outer fixture.

Furthermore, the application provides a lighting device having a low risk of being dropped from an outer fixture.

Technical Solution

According to one aspect of the application, there is provided a lighting device including: a body including a side wall and a base disposed on the side wall; a light source which is disposed below the base of the body; a power supply which is disposed on the base of the body to supply a power to the light source; and a clip including a connection portion and an extension portion extending from the connection portion and disposed on the side wall of the body, the extension portion of the clip having at least one bent portion which is bent toward the side wall of the body.

Preferably, the extension portion of the clip has a curvature equal to or larger than that of the side wall.

Preferably, the extension portion of the clip has a first portion which is interposed between the extension portion of the clip and the bent portion, and a second portion disposed at an end of the clip, and a curvature of the first portion is different from a curvature of the second portion.

Preferably, the extension portion of the clip is extended from an upper end of the side wall to a lower end of the side wall.

The bent portion may be disposed in the range of a point of dividing both ends of the clip into 6 to 4, and a point of dividing both ends into a ratio of 8 to 2.

A bent angle of the bent portion may be in the range of 147 degrees and 157 degrees.

According to another aspect of the application, there is provided a lighting device including: a body including a base, a first side wall disposed below the base, and a second side wall disposed below the first side wall; a light source which is disposed below the base of the body; an optical plate which is disposed below the light source, and is interposed between the first side wall and the second side wall of the body; a power supply which is disposed on the base of the body to supply a power to the light source; and a cover which is disposed on the base of the body to cover the power supply, the first side wall of the body reflecting light emitted from the light source to the optical plate.

Preferably, the body includes a first extension portion which is connected to a lower end of the first side wall, and is disposed above the optical plate, and a second extension portion which is connected to an upper end of the second side wall, and is disposed below the optical plate.

Preferably, a slope of the first side wall relative to a bottom surface of the base of the body is different from a slope of the second side wall relative to the bottom surface of the base.

Preferably, the cover includes a base disposed on the power supply, and a side wall disposed below the base of the cover to enclose the power supply, the lighting device further comprises a clip including a connection portion connected to the side wall of the cover, and an extension portion extending from the connection portion and disposed on the side wall of the cover, and the extension portion of the clip has at least one bent portion which is bent toward the side wall of the cover.

Preferably, the extension portion of the clip has a curvature equal to or larger than that of the side wall.

Preferably, the extension portion of the clip has a first portion which is interposed between the extension portion of the clip and the bent portion, and a second portion disposed at an end of the clip, and a curvature of the first portion is different from a curvature of the second portion.

Preferably, the extension portion of the clip is extended from an upper end of the side wall to a lower end of the side wall.

The bent portion may be disposed in the range of a point of dividing both ends of the clip into 6 to 4, and a point of dividing both ends into a ratio of 8 to 2. A bent angle of the bent portion may be in the range of 147 degrees and 157 degrees.

According to the other aspect of the application, there is provided a lighting device including: a body; a light source which is disposed below the body; and a fixing member which is disposed on the body, and includes a base portion, the base portion of the fixing member having at least one clip fixing shaft and at least one protrusion, the fixing member including a clip which is engaged to the clip fixing shaft so as to be able to rotate, and crosses over the protrusion when rotation, and when the clip crosses over the protrusion, movement of the clip being restricted by the protrusion.

Preferably, the clip has a center portion disposed on the clip fixing shaft, and both ends positioned at both sides of the center portion, one end is disposed in the fixing member, and at least a portion of the other end is disposed out of the fixing member, and when the center portion of the clip rotates around the clip fixing shaft, the one end of the clip moves on the protrusion, and the other end of the clip is away from or close to the fixing member.

Preferably, the fixing member further includes a resilient member which is engaged to the clip fixing shaft to provide a resilient force so that the other end of the clip is maintained to be very close to the fixing member.

Preferably, the resilient member is a torsion spring having a coil portion and first and second ends connected to the coil, and the coil portion is engaged to the clip fixing shaft, the first end is engaged to the one end of the clip, and the second end is disposed on the fixing member.

Preferably, the fixing member further includes a lateral portion to enclose the base portion of the fixing member, and the lateral portion of the fixing member has a clip guide, on which the clip is disposed, and a guide groove in or away from which the other end of the clip comes.

Preferably, the other end of the clip further has a tap protruding outwardly from the other end of the clip.

Preferably, the other end of the clip is inclined downwardly from the center portion of the clip.

A bending angle of the other end to the one end of the clip may be in the range of 162 degrees and 172 degrees.

Preferably, the body includes a base disposed below the base portion of the fixing member, a side wall disposed below the base of the body, and an extension portion extending outwardly from a lower end of the side wall, and the other end of the clip is disposed on the extension portion.

Preferably, the protrusion protrudes upwardly from a top surface of the base portion of the fixing member, and a top surface of the protrusion has two inclined surfaces which are convex in a downward direction.

The lighting device may further include a power supply which is disposed on the fixing member. The body has a base disposed below the base portion of the fixing member, and the fixing member can space the power supply apart from the base of the body at a desired interval.

The fixing member has the base portion which is spaced apart from a top surface of the base of the body at a desired interval, and a lateral portion which is interposed between the top surface of the base of the body and the bottom surface of the base portion of the fixing member. An interval between the top surface of the base of the body and the bottom surface of the base portion of the fixing member is 5 mm or more.

The base portion of the fixing member has at least one boss protruding from the top surface of the base portion of the fixing member. The power supply has a support board disposed on the boss, and components mounted on the support board.

The lateral portion of the fixing member may be formed with at least one hole.

Preferably, the lighting device further includes a reflective member which is disposed below the light source. The reflective member includes a reflector for reflecting light emitting from the light source, and a reflective sheet disposed on the reflector, the reflective sheet is formed in a ring shape having both ends, and one end of the reflective sheet has a connecting portion, and the other end of the reflective sheet has a connecting hole to which the connecting portion is connected.

According to the other aspect of the application, there is provided a lighting device installed to an inside of an outer fixture, the lighting device including: a body; a light source which is disposed below the body; a fixing member which is disposed on the body, and includes a lateral portion; and a plurality of clips which extend outwardly from the lateral portion of the fixing member, wherein each of the clips includes a bent portion, and a difference between an inner diameter of the outer fixture and a diameter of an imaginary circle formed by connecting each bent portion of the plurality of clips is in a range of 3 ø and 15 ø.

A bending angle of the other end to the one end of the clip may be in the range of 162 degrees and 172 degrees.

Preferably, the clip is able to rotate, when the clip rotates, one end of the clip is away from the fixture, while when the clip rotates in an opposite direction, the one end of the clip is close to the fixture.

The lateral portion of the fixing member has a clip guide on which the clip is disposed. The clip guide restricts rotation of each clip.

The body may have a clip fixing shaft for rotating the clip.

The fixing member may have a clip fixing shaft for rotating the clip.

The fixing member may further have a resilient member which is engaged to the clip fixing shaft to provide a resilient force so that the end of the clip is maintained to be close to the fixing member.

The lateral portion of the fixing member may be formed with a guide groove, in or away from which the clip comes.

The clip may further have a tap protruding outwardly from the clip.

Advantageous Effects

With the above configuration, the lighting device can be stably fixed to the outer fixture.

The lighting device can be manufactured inexpensively by lowering material costs.

The lighting device can be more stably fixed to the outer fixture.

The lighting device can reduce an influence of the light source to the power supply.

The lighting device can be easily fixed to the outer fixture.

The lighting device can improve the efficiency of light extraction.

The lighting device can reduce material costs.

The lighting device can be easily detached from the outer fixture.

The lighting device can prevent negligent accident of the worker or user.

The lighting device can prevent the outer fixture from being damaged.

The lighting device can be stably installed to an outer fixture.

The lighting device has a low risk of being dropped from an outer fixture.

DESCRIPTION OF DRAWINGS

FIG. 1 is a perspective view of a lighting device according to a first embodiment when seen from a top.

FIG. 2 is a perspective view of the lighting device in FIG. 1 when seen from a bottom.

FIG. 3 is an exploded perspective view of the lighting device in FIG. 1.

FIG. 4 is an exploded perspective view of the lighting device in FIG. 2.

FIG. 5 is a cross-sectional view of the lighting device in FIG. 1.

FIG. 6 is a view illustrating a case where the lighting device in FIG. 1 is installed in an outer fixture.

FIGS. 7 and 8 are perspective views illustrating an engaged state of a body 100, a clip 170 and a fixing member 500 which are shown in FIG. 3 to explain movement of the clip 170.

FIG. 9 is a plan view of the lighting device in FIG. 1 when seen from a top.

FIG. 10 is a view of a reflective sheet 370 in FIG. 3.

FIG. 11 is a perspective view of a lighting device according to a second embodiment when seen from a top.

FIG. 12 is a perspective view of the lighting device in FIG. 11 when seen from a bottom.

FIG. 13 is an exploded perspective view of the lighting device in FIG. 11.

FIG. 14 is an exploded perspective view of the lighting device in FIG. 12.

FIG. 15 is a cross-sectional view of the lighting device in FIG. 11.

FIG. 16 is a perspective view of a fixing member 500' in FIGS. 13 and 14.

FIG. 17 is a perspective view illustrating a case where a clip 570 is opened.

FIG. 18 is a plan view of the lighting device in FIG. 11.

FIG. 19 is a plan view of clips 570*a* and 570*b* in FIG. 18 which are opened to the max.

FIG. 20 is a view illustrating a member 500" with no resilient members 580*a* and 580*b* in FIG. 16.

FIG. 21 is a perspective view of a lighting device according to a third embodiment when seen from a top.

FIG. 22 is a perspective view of the lighting device in FIG. 21 when seen from a bottom.

FIG. 23 is a plan view of the lighting device in FIG. 21.

FIG. 24 is an enlarged perspective view of only a clip 170' in FIG. 21.

FIG. 25 is a plan view illustrating a case where the lighting device in FIG. 21 is installed in an outer fixture 1000.

FIG. 26 is a perspective view of a lighting device according to a fourth embodiment when seen from a top.

FIG. 27 is a perspective view of the lighting device in FIG. 26 when seen from a bottom.

FIG. 28 is an exploded perspective view of the lighting device in FIG. 26.

FIG. 29 is an exploded perspective view of the lighting device in FIG. 27.

FIG. 30 is a cross-sectional view of the lighting device in FIG. 26.

MODE FOR INVENTION

Hereinafter, lighting device according to preferred embodiments of the application will be described in detail with reference to the accompanying drawings.

With reference to the drawings, a thickness of each line or a scale of each element is modified appropriately in order to make it recognizable.

In case where any one element is formed on or under other element, the phrase "on or under" means that two elements are brought into directly contact with each other, or at least one element is indirectly interposed between two elements. Also, in case where any one element is formed on or under other element, the phrase "on or under" is used to generally describe a downward direction on the basis of one element, as well as describing an upward direction.

First Embodiment

FIG. 1 is a perspective view of a lighting device according to the first embodiment when seen from a top. FIG. 2 is a perspective view of the lighting device in FIG. 1 when seen from a bottom. FIG. 3 is an exploded perspective view of the lighting device in FIG. 1. FIG. 4 is an exploded perspective view of the lighting device in FIG. 2. FIG. 5 is a cross-sectional view of the lighting device in FIG. 1.

Referring to FIGS. 1 to 5, the lighting device includes a body 100, a light source 200, a reflective member 300, an optical member 400, a fixing member 500, a power supply 600, and a cover 700.

The body 100 forms a main appearance of the lighting device according to the first embodiment together with the cover 700.

The body 100 may have a space to house plural members therein. The light source 200, the reflective member 300 and the optical member 400 may be disposed in the space.

The body 100 may be made of a metal or a resin.

The body 100 may have a base 110, a side wall 130, an extension portion 150, and a clip 170. The base 110 and the side wall 130 may form the space.

The base 110 of the body 100 may be a plate having a desired thickness. The base 110 may be formed in a circular shape, but the application is not limited thereto. For example, the base 110 may be formed in an oval or polygonal shape.

The light source 200 is disposed on the base 110. Specifically, a substrate 210 of the light source 200 may be disposed on a bottom surface of the base 110.

The substrate 210 may be fixed to the bottom surface of the base without using a separate fastening member. For example, the reflective member 300 can fix the substrate 210 to the bottom surface of the base 110. Specifically, when an engaging portion 330 of the reflective member 300 is engaged to the base 110, a reflector 310 of the reflective member 300 is brought into close contact with the bottom surface of the base 110, and thus the substrate 210 can be fixed to the base 110. The application is not limited thereto, and the substrate 210 can be fixed to the base 110 by screws or rivets.

Although not shown in the drawings, a heat conducting member for quickly conducting heat from the substrate 210 to the base 110 may be interposed between the base 110 and the substrate 210. The heat conducting member may be a heat conducting sheet or a heat conducting plate.

The base 110 conducts the heat from the light source 200 to the fixing member 500, and can radiate the heat by itself. To this end, the base 110 may be made of metal or resin having high heat conductivity.

The reflective member 300 may be disposed together with the light source 200 below the base 110.

The base 110 may be connected to the reflective member 300. Specifically, the base 110 may be formed with at least one first hole 111. The engaging portion 330 of the reflective member 300 is inserted into the first hole 111, so that the base 110 can be connected to the reflective member 300. Since a hook 335 of the engaging portion 330 is locked to a top surface of the base 110 through the first hole 111, the reflective member 300 is fixed to the base 110.

The base 110 may be formed with a second hole 112. A fastening member, for example, a screw or a rivet, may be engaged to the second hole 112 and a fastening hole 355 of the fastening portion 350 of the reflective member 300.

The base 110 may be formed with a third hole 113. A fastening member, for example, a screw or a rivet B, which is inserted into the first hole 511 of the fixing member 500 may be engaged to the third hole 113. Thus, the fixing member 500 can be fixed to the base 110.

The base 110 may be formed with a fourth hole 114. A member for supplying power to the light source 200 may be disposed in the fourth hole 114. The member for supplying the power may be a connector 250. The fourth hole 114 may be formed in a center of the base 110.

The base 110 may have a clip fixing shaft 115. The clip fixing shaft 115 may protrude upwardly from the top surface of the base 110.

An upper end of the clip fixing shaft 115 may be engaged to a shaft engaging portion 514 of the fixing member 500.

The clip fixing shaft 115 may be engaged to the clip 170. Specifically, the clip fixing shaft 115 may be inserted into a hole formed in one end of the clip 170. The clip 170 can be rotated in a clockwise direction or a counterclockwise direction on the basis of the clip fixing shaft 115.

A plurality of clip fixing shafts 115 may be disposed on the base 110. For example, three clip fixing shafts 115 may be disposed on the top surface of the base 110. The clip 170 can be engaged to each of the three clip fixing shafts 115.

The fixing member 500 may be disposed on the base 110. Specifically, a base portion 510 of the fixing member 500 may be disposed on the top surface of the base 110, and a lateral portion 530 of the fixing member 500 may be disposed at an edge of the top surface of the base 110.

The base 110 and the base portion 510 of the fixing member 500 may be spaced apart from each other at a desired interval D1. When the base 110 of the body 100 and the base portion 510 of the fixing member 500 are spaced apart from at the desired interval D1, the heat from the light source 200 does not have a direct effect on the power supply 600, thereby reducing an amount of the heat from the light source 200 to the power supply 600. The interval D1 between the top surface of the base 110 and the bottom surface of the base portion 510 of the fixing member 500 may be 5 mm or more. When the interval D1 is 5 mm or more, there is an advantage of significantly reducing the amount of the heat conducting from the light source 200 to the power supply 600. When the interval D1 is 7 mm or more, there is no difference in the amount of the heat conducting from the light source 200 to the power supply 600. However, when the interval D1 is 7 mm or more, since a size of the lighting device is increased, the interval dl is preferably in the range 5 mm and 7 mm.

The side wall 130 of the body 100 is connected to the base 110. Specifically, an upper end of the side wall 130 is connected to the edge of the base 110, and a lower end is disposed below the base 110. The lower end of the side wall 130 is connected to the extension portion 150.

The side wall 130 may be formed in a cylindrical shape. The cylindrical side wall 130 may be formed to have a diameter which is continuously increased downwardly from the base 110. An angle between an inner surface of the side wall 130 and the bottom surface of the base 110 is more than 90 degrees and less than 180 degrees.

The side wall 130 may be formed integrally with the base 110, or may be formed separately from the base 110 and be connected to the base 110.

The extension portion 150 of the body 100 may be connected to the lower end of the side wall 130, and be extended outwardly from the lower end of the side wall 130.

The extension portion 150 may be a flat plate. The extension portion 150 may be in parallel with the base 110. The application is not limited thereto, and the extension portion of the flat plate may be inclined in an upward or downward direction. The extension portion 150 may be formed in a ring shape to enclose the side wall 130.

The clip 170 is connected to the body 100.

The clip 170 may have both ends, of which one end is engaged to the body 100, and the other end is disposed at the outside of the body 100.

The other end of the clip 170 may be extended from the one end, and be bent upwardly or downwardly for the purpose of easy engagement. The clip 170 is configured to fix the lighting device according to the first embodiment to the outer fixture. Specifically, it will be described with reference to FIG. 6.

FIG. 6 is a view illustrating a case where the lighting device in FIG. 1 is installed in the outer fixture.

Referring to FIG. 6, the other end of the clip 170 abuts against an inner surface 1100 of the fixture 1000 to be locked thereto, thereby fixing the lighting device according to the first embodiment to the inside of the fixture 1000.

A boundary between ends of the clips 170, i.e., a bent portion of the clip 170, has a desired relationship with an inner diameter of the outer fixture 1000. A diameter D3 of an imaginary circle formed by connecting each bent portion of the plurality of clips 170 may be smaller than an inner diameter D2 of the outer fixture 1000 in order to be easily engaged to the outer fixture 1000. Specifically, a difference (D2−D3) between the inner diameter D2 of the outer fixture 1000 and the diameter D3 of the imaginary circle formed by connecting each bent portion of the plurality of clips 170 may be in the range of 3 ø and 15 ø.

When the diameter difference (D2−D3) is in the range of 3 ø and 15 ø, as illustrated in FIGS. 6*a* and 6*b*, an edge of the other end of the clip 170 (FIG. 6*a*) or a portion of the surface of the other end (FIG. 6*b*) comes appropriately into contact with the inner surface of the outer fixture 1000, and the lighting device is stably fixed in the outer fixture 1000 by the restoring force of the clip 170.

When the diameter difference (D2−D3) is less than 3 ø, it is difficult to insert the clip 170 in the inside of the outer fixture 1000, and the edge of the other end of the clip 170 or a portion of the surface of the other end is hardly locked to the inner surface of the outer fixture 1000. As illustrated in FIG. 6*c*, since the wide surface of the other end of the clip 170 comes into contact with the inner surface 1000 of the outer fixture 1000 to form a surface contact, installation of the lighting device can be unstable.

When the diameter difference (D2−D3) is more than 15 ø, the clip 170 is easily installed to the outer fixture 1000, but a binding force between the edge of the other end of the clip 170 or a portion of the surface of the other end and the inner surface 1100 of the outer fixture 1000 by the restoring force of the clip 170 is low, so that the fixation is not easy, and the lighting device is possibly dropped.

A bending angle t of the bent portion of the clip 170, i.e., a bending angle of the other end to the one end of the clip 170, may be in the range of 162 degrees and 172 degrees.

When the bending angle t is within the above range, even though the clip 170 is bent after it is installed to the outer fixture 1000, as illustrated in FIGS. 6*a* and 6*b*, the edge of the other end of the clip 170 or a portion of the surface of the other end is fixed at a proper position of the inner surface 1100 of the outer fixture 1000, thereby lowering the dropping possibility of the lighting device.

However, when the bending angle t is out of the range, the edge of the other end of the clip 170 or a portion of the surface of the other end is not locked to the inner surface 1100 of the outer fixture 1000, and as illustrated in FIG. 6*c*, almost surface of the other end of the clip 170 abuts against the inner surface of the outer fixture 1000, thereby increasing the dropping risk of the lighting device.

Referring again to FIGS. 3 to 5, the clip 170 is engaged to the base 110. Specifically, one end of the clip 170 is engaged to the clip fixing shaft 115 of the base 110, and the other end is able to rotate around the one end as a shaft.

Rotation of the clip 170 can be limited by the fixing member 500. Specifically, it will be described in detail with reference to FIGS. 7 to 9.

FIGS. 7 and 8 are perspective views illustrating the engaged state of the body 100, the clip 170 and the fixing member 500 which are shown in FIG. 3 to explain movement of the clip 170. FIG. 9 is a plan view of the lighting device in FIG. 1 when seen from a top.

Specifically, FIG. 7 shows the state in which the clip 170 is opened as much as possible, that is, the other end of the clip 170 is disposed farthest away from the fixing member 500. FIG. 8 shows the state in which the clip 170 is retracted as much as possible, that is, the other end of the clip 170 is disposed nearest to the fixing member 500.

Referring to FIGS. 7 and 8, a portion of the lateral portion 530 of the fixing member 500 may have a clip guide 535 for providing a passage along which the clip 170 can rotate. A portion of the clip 170 is disposed in the fixing member 500 by the clip guide 535, while the remaining portion of the clip 170 is disposed out of the fixing member 500. The rotation of the clip 170 is limited by the clip guide 535.

The clip 170 rotates along the clip fixing shaft 115 in the clip guide 535, and a distance from the fixing member 500 to an edge of the other end of the clip 170 is varied depending upon a rotation direction. Specifically, referring to FIG. 9, a length D4 from the outer surface of the fixing member 500 to ends of two left clips 170 among three clips 170 is shorter than a length D5 from the fixing member 500 to an end of the remaining clip.

Referring to FIG. 9, when the clip 170 is opened as much as possible, the other end of the clip 170 is disposed out of the extension portion 150 of the body 100, as illustrated in FIG. 7. Meanwhile, as illustrated in FIG. 8, when the clip 170 is retracted as much as possible, the other end of the clip 170 is disposed in the extension portion 150 or is overlapped with the extension portion 150.

The method of fixing the lighting device according to the first embodiment to the outer fixture 1000 in FIG. 6 includes unfolding the clip 170 as much as possible, as illustrated in FIG. 7, and inserting the lighting device into the outer fixture 1000. The other end of the clip 170 abuts against the inner surface of the outer fixture 1000 by the restoring force of the clip 170, and is locked thereto, thereby supporting the lighting device.

The method of separating the lighting device according to the first embodiment from the outer fixture 1000 in FIG. 6 includes rotating the extension portion 150 of the body 100 in the direction to fold the clip 170, so that the clip 170 comes to the state shown in FIG. 8. Therefore, it is possible to easily separate the lighting device according to the first embodiment from the outer fixture 1000.

Referring again to FIGS. 1 to 5, the light source 200 is disposed in the body 100. Specifically, the light source 200 may be disposed on the base 110 of the body 100.

The light source 200 may have the substrate 210 and a light emitting element 230. The light source 200 may further include the connector 250 for supplying the power.

The substrate 210 may be disposed on the bottom surface of the base 110 of the body 100. The top surface of the substrate 210 may be brought into contact with the bottom surface of the base 110. When the top surface of the substrate 210 is brought into contact with the bottom surface of the base 110, the heat generated from the light emitting element 230 can be directly conducted to the base 110 via the substrate 210. A heat conducting member, such as a heat conducting sheet, heat conducting grease, or a heat conducting plate, may be interposed between the substrate 210 and the base 110.

The plurality of light emitting elements 230 for emitting the light may be disposed on the bottom surface of the substrate 210.

The substrate 210 may be an insulator which is printed by a circuit pattern, and may include a general printed circuit board (PCB), a metal core PCB, a flexible PCB, and a ceramic PCB, for example.

The substrate 210 may be formed with at least one guide groove 215. The guide groove 215 may be a slot formed on an edge of the substrate 210 in a diameter direction.

The guide groove 215 may be engaged to a guide 351 of the fastening portion 350 of the reflective member 300. The engaging direction and position between the substrate 210 and the reflective member 300 can be correctly verified by the guide groove 215 and the guide 351.

The bottom surface of the substrate 210 may be coated by any material capable of effectively reflecting the light, or any color, such as white or silver, capable of effectively reflecting the light. Alternatively, a reflective sheet may be positioned around the light emitting element 230 on the bottom surface of the substrate 210 to effectively reflect the light and thus improve the efficiency. The reflective sheet may be a sheet of which a PMMA or substrate is coated by a metal having high reflectivity. The metal having the high reflectivity may contain at least one of Ag, Al, Pt, Cr, Ni, or Cu.

The substrate 210 is formed in the circular shape, as illustrated in the drawings, but the application is not limited thereto. The substrate 210 may be formed in an oval shape or polygonal shape.

The light emitting element 230 is disposed on the substrate 210. Specifically, single or plural light emitting elements 230 may be disposed on the bottom surface of the substrate 210. In case where single light emitting element is disposed, the light emitting element may be single light emitting element package having a light emitting element of high efficiency. In case where plural light emitting elements are disposed, the light emitting element may be single light emitting element package having a plurality of light emitting elements, a plurality of single packages having single light emitting element, or a plurality of single packages having a plurality of light emitting elements.

The light emitting element 230 may be a light emitting diode chip emitting red, green and blue lights, or a light emitting diode chip emitting ultraviolet rays. The light emitting diode may be any one of a lateral type, a vertical type, or a flip-chip type.

A lens (not shown) may be disposed on the light emitting element 230. The lens may be disposed to completely cover the light emitting element 230. The lens can adjust an orientation angle of the light or a direction of the light emitted from the light emitting element 230. The lens is made of a transparent resin, such as a silicon resin or an epoxy resin, and may be formed in a hemispheric shape. The transparent resin may be dispersed wholly or partially with phosphor material.

In case where the light emitting element 230 is the blue light emitting diode, the phosphor material contained in the transparent resin may include at least one of garnet phosphor (YAG and TAG), silicate phosphor, nitride phosphor, and oxynitride phosphor.

Although natural light (white light) can be realized by containing only yellow emitting phosphor in the transparent resin, the phosphor material may further contain green emitting phosphor or red emitting phosphor in order to increase a color rendering index and reduce color temperature.

In case where the transparent resin contains various kinds of phosphors, much green emitting phosphor may be added rather than the red emitting phosphor, and much yellow emitting phosphor may be added rather than the green emitting phosphor. The yellow emitting phosphor may include yttrium aluminum garnet (YAG), silicates, and oxynitrides, the green emitting phosphor may include silicates and oxynitrides, and the red emitting phosphor may include nitrides. The transparent resin may be mixed with several kinds of phosphors, but may include a layer of the red emitting phosphor, a layer of the green emitting phosphor, and a layer of the yellow emitting phosphor which are separated from each other.

The connector 250 may be disposed on the substrate 210. The connector 250 is electrically connected to the power supply 600 to provide a power signal for driving the light emitting element 230 to the substrate 210.

The connector may be disposed at the center of the substrate 210. The connector 250 may be inserted into the fourth hole 114 formed in the base 110 of the body 100.

The connector 250 may be electrically connected to the power supply via a conductive member, for example, an electric cable or an electrode pin, and may be directly connected to a connector (not shown) which is disposed on one surface of a support board 610 of the power supply 600. In case of no connector 250, an electric cable electrically connected to the power supply 600 may be directly connected to the substrate 210 by welding to supply the power.

The reflective member 300 is disposed in the body 100, and is positioned above the light source 200 to concentrate or disperse the light emitted from the light source 200.

The reflective member 300 may have the reflector 310, the engaging portion 330, and the fastening portion 350.

The reflector 310 of the reflective member 300 may be disposed below the substrate 210. Specifically, an upper end of the reflector 310 may be disposed on the bottom surface or the lateral surface of the substrate 210.

The reflector 310 may be disposed to enclose the plurality of the light emitting elements 230 positioned on the bottom surface of the substrate 210.

The reflector 310 may be formed in a cylindrical shape having openings in upper and lower ends thereof. The upper opening may be smaller than the lower opening. The reflector 310 may have a reflective surface between the upper opening and the lower opening, and the reflective surface forms an obtuse angle to the bottom surface of the substrate 210. The reflective surface may be made of a light reflecting material or be coated by a light reflecting material in order to easily reflect the light emitting from the light emitting element 230.

The lower end of the reflector 310 may be engaged to a guider 430 of the optical member 400. Specifically, the lower end of the reflector 310 may have a fastening portion 315 which is engaged to a coupling portion 431 of the guider 430. The coupling portion 431 of the guider 430 is inserted into the fastening portion 315, and then a hook 435 is locked to a protrusion 315*a* of the fastening portion 315, thereby firmly engaging the reflector 310 and the optical member 400.

The engaging portion 330 of the reflective member 300 is disposed on the reflector 310. Specifically, the engaging portion 330 may protrude upwardly from the outer surface of the reflector 310.

The engaging portion 330 is inserted into the first hole 111 formed in the base 110 of the body 100. The engaging portion 330 may have the hook 335. The hook 335 is disposed on the top surface of the base 110 of the body 100 to fix the reflective member 300 to the body 100.

The upper end of the engaging portion 330 may be engaged to a second hole 512 of the fixing member 500. The engaging portion 330 is engaged to the second hole 512 of the fixing member 500, so that the fixing member 500 can be engaged to the body 100 at the correct position.

The fastening portion 350 of the reflective member 300 is disposed on the reflector 310. Specifically, the fastening portion 350 protrudes upwardly from the outer surface of the reflector 310.

The fastening portion 350 can fix the body 100 and the reflective member 300 in the further stable manner. By fastening a fastening member, such as a screw or a rivet, into the fastening hole 355 of the fastening portion 350 and the second hole 112 of the base 110, the reflective member 300 can be further stably fixed to the body 100.

The fastening portion 350 may have the guide 351. The guide 351 is engaged to the guide groove 215 of the substrate 210 to guide the position and direction of the substrate 210.

The reflective member 300 may have a reflective sheet. The reflective sheet 370 is disposed on the reflective surface of the reflector 310.

The reflective sheet 370 may be white paper, or may be paper coated by a substance having high light reflectivity. The reflective sheet 370 improves the reflective efficiency to improve the efficiency of light extraction obtained by the lighting device. Also, since the reflective sheet 370 can be used in case where it is not expensive substance having the high light reflectivity, it is possible to lower material costs of the reflector 310. Specifically, the reflective sheet 370 will now be described with reference to FIG. 10.

FIG. 10 is a view of the reflective sheet 370 in FIG. 3.

Referring to FIG. 10, the reflective sheet 370 may be formed in a ring shape which is generally circular and has an opening at a center. A portion of the ring-shaped reflective sheet 370 is removed, so that the reflective sheet 370 has both ends. Both ends of the reflective sheet 370 are connected to each other. When both ends are connected to each other, an upper diameter of the reflective sheet 370 is larger than a lower diameter, as illustrated in FIGS. 3 and 4, for example, to form a funnel shape.

One end of the reflective sheet 370 has a connecting portion 371, and the other end of the reflective sheet 373 has a connecting hole 373.

The connecting portion 371 may be extended outwardly from the one end of the reflective sheet 370. The connecting portion 371 may be formed in such a way that the width is widened from the one end of the reflective sheet 370 toward an outward direction.

For example, the connecting portion 371 may be a hook. The hook-type connecting portion 371 is inserted and fixed to the connecting hole 373 of the reflective sheet 370.

The connecting hole 373 is formed in the other end of the reflective sheet 370, and may be a slot penetrating the reflective sheet 370.

Referring again to FIGS. 1 to 5, the optical member 400 is disposed in the body 100, and radiates outwardly the light emitted from the light source 200 and the reflective member 300.

The optical member 400 may have an optical plate and the guider 430.

The optical plate 410 is disposed above the light source 200 and the reflective member 300. The optical plate 410 receives the light from the light emitting element 230 of the light source 200 and the light reflected from the reflector 310 of the reflective member 300, and optically processes the incident light to emit the light outwardly. The phrase "optically process" is used herein to describe that it diffuses the incident light or alters a wavelength of the incident light. The incident light may be diffused by a light scatter or a diffusing sheet, or the surface of the optical plate 410 may have desired roughness to diffuse the incident light. The wavelength of the incident light may be altered by a phosphor or a fluorescent film.

The optical plate 410 may be fixed between the reflective member 300 and the guider 430. Specifically, the guider 430 is engaged to the reflector 310 of the reflective member 300 in the state in which an edge of the optical plate 410 is enclosed by the guider 430, so that the optical plate 410 is fixed between the reflective member 300 and the guide 430.

The guider 430 may be formed in a ring shape in order to enclose the edge of the optical plate 410. The guider 430 may have the coupling portion 431 which is connected to the reflector 310 of the reflective member 300. The coupling portion 431 may have the hook 435 which is locked to the protrusion 315*a* of the fastening portion 315 of the reflector 310.

The fixing member 500 is disposed on the body 100. Specifically, the fixing member 500 is disposed on the base 110 of the body 100.

The fixing member 500 is interposed between the body 100 and the cover 700. The fixing member 500 interposed between the body 100 and the cover 700 spaces the base 110 of the body 100 and the power supply 600 disposed in the cover 700, thereby decreasing an amount of the heat from the light source 200 to the power supply 600. Accordingly, the lighting device according to the first embodiment can improve the heat radiating performance.

The fixing member 500 may have the base portion 510 and the lateral portion 530.

As illustrated in FIG. 5, the base portion 510 of the fixing member 500 is spaced apart from the top surface of the base 110 of the body 100 at a desired interval D1. Accordingly, an empty space is formed between the base portion 510 of the fixing member 500 and the base 110 of the body 100. Since the empty space serves as a storage of the heat from the light source 200, it is possible to significantly decrease the amount of the heat conducted from the power supply 600, rather than the case where there is no empty space.

The base portion 510 may have the first hole 511. A fastening member B, such as a screw or a rivet, is inserted into the first hole 511, and then is fastened to the third hole 113 formed in the base 110 of the body 100, so that the fixing member 500 is fixed to the body 100.

The base portion 510 may be formed with the second hole 512. The upper end of the engaging portion 330 of the reflective member 300 is inserted into the second hole 512 through the first hole 111 formed in the base 110 of the body 100. The engaging position between the fixing member 500 and the body 100 can be correctly aligned by the second hole 512.

The base portion 510 may be formed with a third hole 513. The connector 250 of the light source 200 can be electrically connected to the power supply by the third hole 513.

The base portion 510 may have the shaft engaging portion 514. The shaft engaging portion 514 is disposed on the bottom surface of the base portion 510, and is engaged to the clip fixing shaft 115 of the base 110 of the body 100.

The base portion 510 may have a boss 515. The boss 515 protrudes upwardly from the tom surface of the base portion 510. A plurality of bosses 515 may be disposed to support the support board 610 of the power supply 600. Since the power supply 600 is spaced apart from the base portion 510 at a desired interval by the bosses 515, the power supply 600 is less influenced by the light source 200, rather than a case where there is no boss 515.

The lateral portion 530 of the fixing member 500 supports the base portion 510 so that the base portion is spaced apart from the base 110 of the body 100 at a desired interval.

The lateral portion 530 is extended upwardly or downwardly from an extension portion of the base portion 510, and may be formed in a cylindrical shape.

As illustrated in FIGS. 7 and 8, the lateral portion 530 may have the clip guide 535. The clip guide 535 is provided with the clip 170. The rotation of the clip 170 is limited by the clip guide 535.

The lateral portion 530 may be formed with at least one air flow hole (not shown). The heat confined in the space between the base 110 of the body 100 and the base portion 510 of the fixing member 500 is discharged outwardly through the air flow hole.

The power supply 600 is disposed on the fixing member 500. Specifically, the power supply 600 is disposed on the base portion 510 of the fixing member 500. The power supply 600 is disposed on the bosses 515 formed on the top surface of the base portion 510 of the fixing member 500, and thus is spaced apart from the base portion 510 of the fixing member 500 at the desired interval.

The power supply 600 may be electrically connected to the connector 250 of the light source 200 by the third hole 513 of the fixing member 500. The connection between the power supply 600 and the connector 250 of the light source 200 can be achieved by an electric cable, or the connector 250 can be directly connected to the power supply 600.

The power supply 600 may have the support board 610 and components disposed on the support board 610.

The support board 610 may be disposed on the bosses 515 of the base portion 510 of the fixing member 500. Since the space is formed between the support board 610 and the base portion 510, the heat is not directly applied to the support board 610 from the fixing member 500. Therefore, it is possible to minimize the damage of the components 630 due to the heat.

The component 630 may include, for example, an AC/DC converter for converting an AC power supplied from the outer supply source into a DC power, a driving chip for controlling drive of the light source 200, and an ESD (Electro Static Discharge) protector for protecting the light source 200, but the application is not limited thereto.

The cover 700 is disposed on the fixing member 500 to cover the power supply 600. Specifically, the cover 700 can be engaged to the base portion 510 of the fixing member 500, while covering the power supply 600. The power supply 600 is closed by the cover 700 so as to be protected from exterior alien substances.

The cover 700 can be engaged to the fixing member 500 by a fastening member, such as a screw or a rivet. The cover 700 and the fixing member 500 can be engaged at once by the fastening member B for engaging the fixing member 500 and the body 100.

The cover 700 may be provided with a pin 750. The pin 750 is electrically connected to the power supply 600 to transfer the exterior power to the power supply 600. The connection between the pin 750 and the power supply 600 can be electrically connected to each other by an electric cable.

Second Embodiment

FIG. 11 is a perspective view of a lighting device according to the second embodiment when seen from a top. FIG. 12 is a perspective view of the lighting device in FIG. 11 when seen from a bottom. FIG. 13 is an exploded perspective view of the lighting device in FIG. 11. FIG. 14 is an exploded perspective view of the lighting device in FIG. 12. FIG. 15 is a cross-sectional view of the lighting device in FIG. 11.

The lighting device according to the second embodiment shown in FIGS. 11 to 15 is substantially identical to the lighting device according to the first embodiment shown in FIGS. 1 to 5, except for some components.

The differences between the lighting device according to the second embodiment shown in FIGS. 11 to 15 and the lighting device according to the first embodiment shown in FIGS. 1 to 5 are a body 100', a reflective member 300', and a fixing member 500'. The light source 200, the optical member 400, the power supply 600, and the cover 700 are substantially identical to those of the lighting device according to the first embodiment shown in FIGS. 1 to 5, and thus the detailed description will be omitted herein.

Hereinafter, the body 100', the reflective member 300', and the fixing member 500' will be described in detail, in which the same components as those in the body 100, the reflective member 300, and the fixing member 500 of the lighting device according to the first embodiment are indicated by the same reference numerals, and the description thereof will be omitted therein.

Referring to FIGS. 11 and 15, a base 110' of the body 100' may be formed with guide holes 116*a* and 116*b*. The guide holes 116*a* and 116*b* may be engaged with guide bosses 516*a* and 516*b* of the fixing member 500'. The engaging position and direction of the fixing member 500' and the body 100' can be correctly verified by the guide holes 116*a* and 116*b*.

The guide holes 116*a* and 116*b* may be formed on a top surface of the base 110'. The guide holes 116*a* and 116*b* may be provided on the top surface of the base 110' as a groove type. Since the guide bosses 516*a* and 516*b* of the fixing member 500' are inserted into the guide holes 116*a* and 116*b*, the fixing member 500' can be correctly disposed on the base 110' of the body 100'.

The fixing member 500' is disposed on the body 100'. Specifically, the fixing member 500' may be disposed on the base 110' of the body 100'.

The fixing member 500' may have the base portion 510' and a lateral portion 530'.

A bottom surface of the base portion 510' of the fixing member 500' may be disposed to be brought into contact with the top surface of the base 110' of the body 100', as illustrated in FIG. 15. The application is not limited thereto, and as illustrated in FIG. 5, the base portion 510' of the fixing member 500' may be spaced apart from the base 110' of the b 100' at a desired interval.

The lateral portion 530' is disposed to enclose the base portion 510', as illustrated in FIG. 15. Specifically, the lateral portion 530' may be disposed to enclose an edge of the base portion 510'. Also, the lateral portion 530' may be interposed between the body 100' and the cover 700.

The fixing member 500' will be described in detail with reference to FIGS. 16 and 17.

FIG. 16 is a perspective view of the fixing member 500' in FIGS. 13 and 14. FIG. 17 is a perspective view illustrating a case where the clip 570 is opened.

Referring to FIG. 16, the base portion 510' of the fixing member 500' may have at least one protrusion 517*a*. The protrusion 517*a* may be disposed on the top surface of the base portion 510'. When a clip 570*a* is rotated by an external force, a portion of both ends of the clip 570*a* crosses over the protrusion 517*a*. When the one end of the clip 570*a* crosses over the protrusion 517*a*, the protrusion 517*a* restricts movement of the clip 570*a* even though the external force is not again applied thereto. Specifically, as illustrated in FIG. 17, the protrusion 517*a* blocks the one end of the clip 570*a* so that the clip 570*a* does not cross over the protrusion 517*a*.

The base portion 510' of the fixing member 500' may be at least one clip fixing shaft 518*a* and 518*b*. The clip fixing shafts 518*a* and 518*b* may be disposed on the top surface of the base portion 510'. The clip fixing shafts 518*a* and 518*b* may be provided with clips 570*a* and 570*b* and resilient members 580*a* and 580*b*. Specifically, a portion of the clips 570*a* and 570*b* and the resilient members 580*a* and 580*b* may be inserted into the clip fixing shafts 518*a* and 518*b*. The clips 570*a* and 570*b* can be rotated around the clip fixing shafts 518*a* and 518*b*.

The fixing member 500' may have at least one of clips 570*a* and 570*b*. The respective clips 570*a* and 570*b* is engaged to the clip fixing shafts 518*a* and 518*b* of the base portion 510' of the fixing member 500'. The respective clips 570*a* and 570*b* can be rotated around the clip fixing shafts 518*a* and 518*b* in a clockwise or counterclockwise direction.

The clips 570*a* and 570*b* are configured to fix the lighting device according to the second embodiment to the outer fixture 1000 shown in FIG. 6. Specifically, the clips 570*a* and 570*b* support an inner surface 1100 of the outer fixture 1000 shown in FIG. 6 to fix the lighting device according to the second embodiment to the inside of the outer fixture 1000.

Since three clips 570*a* and 570*b* shown in the drawings have the same shape, the structure of the clips 570*a* and 570*b* will be described in detail with reference to the second clip 570*b*.

The second clip 570*b* may have a center portion 571*b*, the one end 573*b* and the other end 575*b* which are disposed at both ends of the center portion 571*b*.

The center portion 571*b* is engaged to the clip fixing shaft 518*b*, and is supported by the clip fixing shaft 518*b* on the base portion 510'. The center portion 571*b* can rotate around the clip fixing shaft 518*b*. The center portion 571 may be formed in a plate shape. At rotation, as illustrated in FIG. 17, a portion of the center portion 571*b* may be disposed at the outside of the lateral portion 530' of the fixing member 500'.

The one end 573*b* is disposed at one of both ends of the center portion 571*b*. The one end 573*b* may be formed in a plate shape, like the center portion 571*b*. The one end 573*b* of the plate shape may be bent downwardly from the one end of the center portion 571*b* of the plate shape. Accordingly, a bottom surface of the one end 573*b* and a bottom surface of the center portion 571*b* form an obtuse angle. When the center portion 571 rotates around the clip fixing shaft 518*b*, the one end 573*b* moves on the protrusion 517*b*.

The one end 573*b* may be engaged to the resilient member 580*b*. Specifically, the one end 573*b* may be formed with a hole to which the one end of the resilient member 580*b* is inserted.

The other end 575*b* is disposed at the other end of the center portion 571*b*. The other end 575*b* may be formed in a plate shape, like the center portion 571*b*. The other end 575*b* of the plate shape may be bent downwardly from the other end of the center portion 571*b* of the plate shape. Accordingly, a bottom surface of the one end 575*b* and the bottom surface of the center portion 571*b* form an obtuse angle. When the center portion 571 rotates around the clip fixing shaft 518*b*, the other end 575*b* is away from the fixing member 500' or is close to the fixing member 500'.

A bending angle s between the bottom surface of the other end 575*b* and the bottom surface of the center portion 571*b* may be in the range of 162 degrees and 172 degrees.

When the bending angle s is within the range, even though the clip 570*b* is installed to the outer fixture 1000 in FIG. 6, and is bent, the edge of the clip 570*b* is fixed at a proper position of the inner surface 1100 of the outer fixture 1000, thereby lowering a dropping risk of the lighting device.

When the bending angle s is out of the range, the edge of the clip 570*b* is not caught by the inner surface 1100 of the outer fixture 1000 shown in FIG. 6, and the side between two edges is brought into contact with the inner surface of the outer fixture 1000, thereby increasing the dropping risk of the lighting device.

The other end 575*b* may come in or out from a guide groove 531' formed on the lateral portion 530' of the fixing member 500 shown in FIG. 17. Specifically, as illustrated in FIG. 16, when the center portion 571*b* rotates around the clip fixing shaft 518*b* in the state in which the other end 575*b* is inserted in the guide groove 531', the other end 575*b* comes out from the guide groove 531', as illustrated in FIG. 17, and is disposed out of the lateral portion 530' of the fixing member 500'.

As illustrate in FIG. 16, a portion of the other end 575*b* can come in or out from the guide groove 531', but the application is not limited thereto. The whole other end 575*b* can come in or out from the guide groove 531'.

The other end 575*b* may have a tap 575*b*-1. The tap 575*b*-1 may protrude outwardly from one side of the other end 575*b*. The tap 575*b*-1 is provided for the convenience of a user, and is configured to easily insert or withdraw the other end 575*b* of the second clip 570*b* to or from the guide groove 531' of the fixing member 500'.

When the other end 575*b* comes out from the guide groove 531' and then is positioned out of the lateral portion 530' of the fixing member 500', the other end 575*b*' is disposed on the extension portion 150 of the body 100', which will be described in detail with reference to FIGS. 18 and 19.

FIG. 18 is a plan view of the lighting device in FIG. 11. FIG. 19 is a plan view of the clips 570*a* and 570*b* in FIG. 18 which are opened to the max.

Referring to FIGS. 18 and 19, in case where the clips 570*a* and 570*b* of the lighting device according to the second embodiment are opened to the max, the other ends of the clips 570*a* and 570*b* may be disposed on the extension portion 150 of the body 100', which is different from the position of the other end of the clip 170 of the lighting device according to the first embodiment in FIG. 9.

When the other ends of the clips 570*a* and 570*b* are disposed on the protrusion 150 of the body 100' in the state in which the clips 570*a* and 570*b* are opened to the max, it has advantageous rather than the case where the other ends of the clips are disposed out of the extension portion 150. For example, it is possible to reduce an accident caused by the clip rather than the case where the other ends of the clip are disposed out of the extension portion 150.

Referring again to FIGS. 16 and 17, the fixing member 500' may have at least one resilient member 580*a* and 580*b*. The resilient members 580*a* and 580*b* are engaged to the clip fixing shafts 518*a* and 518*b* and the clips 570*a* and 570*b* to provide a resilient force so that the other ends of the clips 570*a* and 570*b* are maintained to be very close to the fixing member 500'.

The resilient members 580*a* and 580*b* may be a torsion spring. The torsion springs 580*a* and 580*b* are a kind of spring which is made by twisting a metal wire. The resilient member has a coil portion of which the metal wire is spirally wound, and first and second ends which are respectively connected to the coil portion. The coil portion of the second torsion spring 580*b* is connected to the clip fixing shaft 518*b*, the first end of the second torsion spring 580*b* is connected to the one end 573*b* of the second clip 570*b*, and the second end of the second torsion spring 580*b* is disposed on the fixing member 500'.

The resilient members 580*a* and 580*b* maintains the state in which the other ends 575*b* of the clips 570*a* and 570*b* are inserted into the guide groove 531' formed on the lateral portion 530' of the fixing member 500', and provides the desired resilient force to insert the other ends 575*b* of the clips 570*a* and 570*b* into the guide groove 531' in the state in which the other ends 575*b* of the clips 570*a* and 570*b* come out from the guide groove 531'.

The lateral portion 530' of the fixing member 500' may be formed with the guide grooves 531'. The other ends 575*b* of the clips 570*a* and 570*b* are disposed in the guide grooves 531'.

The lateral portion 530' of the fixing member 500' may have the clip guide 535. The clips 570*a* and 570*b* are disposed on the clip guide 535. The clip guide 535 restricts the rotation of the clips 570*a* and 570*b*. The clip guide 535 can be connected to the guide groove 531'.

The operation of the clips 570*a* and 570*b* of the lighting device according to the second embodiment will be described in detail with reference to FIGS. 16 and 17.

When the user pulls the tap 575*b*-1 of the clips 57-*a* and 570*b* in the state in which the other ends 575*b* of the clips 570*a* and 570*b* are inserted into the guide groove 531' formed on the lateral portion 530' of the fixing member 500', as illustrated in FIG. 16, the clips 570*a* and 570*b* rotate around the clip fixing shafts 518*a* and 518*b* in the clockwise direction.

When the clips 570*a* and 570*b* rotate to some degree by the user, the one ends 571*b* of the clips 570*a* and 570*b* cross over the protrusions 517*a* and 517*b*. After the one ends 571*b* of the clips 570*a* and 570*b* cross over the protrusions 517*a* and 517*b*, the user releases the taps 575*b*-1 of the clips 570*a* and 570*b*, the clips 570*a* and 570*b* are about to return to the original state by the restoring force of the resilient members 580*a* and 580*b*. However, since the one ends 571*b* of the clips 570*a* and 570*b* do not cross over the protrusions 517*a* and 517*b* again, the clips 570*a* and 570*b* are maintained in the state, as illustrated in FIG. 17.

When the user directly or indirectly applies desired force to the clips 570*a* and 570*b* in the counterclockwise direction, the one ends 571*b* of the clips 570*a* and 570*b* cross over the protrusions 517*a* and 517*b*. As soon as the one ends 571*b* of the clips 570*a* and 570*b* cross over the protrusions 517*a* and 517*b*, the clips 570*a* and 570*b* are automatically returned to the state shown in FIG. 16 by the resilient members 580*a* and 580*b*.

Since the clips 570*a* and 570*b* are automatically retracted, the lighting device according to the second embodiment can be easily removed from the outer fixture 1000 shown in FIG. 6. Also, since the retracted clips 570*a* and 570*b* are not again opened without other external force, it is possible to prevent the accident of the worker or user due to the clips 570*a* and 570*b*. In addition, when the lighting device is removed from the outer fixture 1000, the inner surface 1100 of the outer fixture 1000 is not damaged by the clips 570*a* and 570*b*.

The fixing member 500' illustrated in FIGS. 16 and 17 may not have the resilient members 580*a* and 580*b*, which will be described with reference to FIG. 20.

FIG. 20 is a view illustrating a member 500" with no resilient members 580*a* and 580*b* in FIG. 16. The upper drawing of FIG. 20 shows the clip 570*b* in the state of FIG. 16, while the lower drawing of FIG. 20 shows the clip 570*b* in the state of FIG. 17.

Referring to FIG. 20, the member 500" does not have the fixing member 500' and the resilient members 580*a* and 580*b* which are shown in FIGS. 16 and 17. The member 500" illustrated in FIG. 20 has a protrusion 517*b'* of which a shape is different from that of the protrusion 517*b* illustrated in FIGS. 16 and 17.

The protrusion 517*b'* shown in FIG. 20 is higher than the protrusion 517*b* shown in FIG. 16. The top surface of the protrusion 517*b* shown in FIG. 16 is convex upwardly, but the top surface of the protrusion 517*b'* shown in FIG. 20 has two inclined surfaces which are convex downwardly.

The clip 570*b* can perform in a way similar to the operation of the clip 570*b* shown in FIGS. 16 and 17, by the member 500" having the protrusion 517*b'*.

Third Embodiment

FIG. 21 is a perspective view of a lighting device according to the third embodiment when seen from a top. FIG. 22 is a perspective view of the lighting device in FIG. 21 when seen from a bottom. FIG. 23 is a plan view of the lighting device in FIG. 21.

The lighting device according to the third embodiment shown in FIGS. 21 to 23 is substantially identical to the lighting device according to the first embodiment shown in FIGS. 1 to 5, except for some components.

The differences between the lighting device according to the third embodiment shown in FIGS. 21 to 23 and the lighting device according to the first embodiment shown in FIGS. 1 to 5 are a clip 170'.

Specifically, the clip 170 of the lighting device according to the first embodiment shown in FIGS. 1 to 5 is disposed on the top surface of the base 110 of the body 100, a portion of the clip 170 is disposed in the fixing member 500, and the remainder is exposed outwardly. The clip 170' of the lighting device according to the third embodiment shown in FIGS. 21 to 23 is disposed on the side wall 130 of the body 100, and the whole clip 170' is exposed outwardly. Also, the clip 170' of the lighting device according to the third embodiment shown in FIGS. 21 to 23 has the shape different from that of the clip 170 of the lighting device according to the first embodiment shown in FIGS. 1 to 5, and a way of fixing the lighting device to the outer fixture 1000 shown in FIG. 6 is different.

Hereinafter, the clip 170' will be described in detail. For reference, the same component in the lighting device according to the third embodiment shown in FIGS. 21 to 23 as those in the lighting device according to the first embodiment shown in FIGS. 1 to 5 are indicated by the same reference numerals.

Referring to FIGS. 21 to 23, the clip 170' is disposed on the side wall 130 of the body 100. Specifically, a plurality of clips 170' may be disposed on the outer surface of the side wall 130.

One end of the clip 170' is connected to the side wall 130 of the body, and the remaining portion is disposed on the side wall 130 of the body 100.

The clip 170' may have both ends. One end is disposed on the upper end of the side wall 130, and the other end of the clip 170' is disposed on the lower end of the side wall 130 of the body 100. Accordingly, the clip 170' may have a shape which is generally inclined downwardly from the top.

More specifically, the clip 170' may have a connection portion 171' and an extension portion 173', which will be described in detail with reference to FIG. 24.

FIG. 24 is an enlarged perspective view of only the clip 170' in FIG. 21.

Referring to FIGS. 21 to 24, the connection portion 171' is connected to the side wall 130 of the body 100. Specifically, the connection portion 171' may be connected to the upper end of the side wall 130 of the body 100. The connection portion 171' and the side wall 130 can be connected to each other by the fastening member, such as a screw or a rivet. To this end, the connection portion 171' may be formed with a hole 171*a'* to which the fastening member is inserted. Also, the connection portion 171' may be formed in a plate shape. In this instance, a bottom surface of the connection portion 171' is disposed to abut against the outer surface of the side wall 130.

The extension portion 173' may be extended in one direction from the connection portion 171'. The direction may be a direction of slant, specifically, a direction extending from the upper end of the side wall 130 to the lower end of the side wall 130.

One end of the extension portion 173' is disposed on the side wall 130, as illustrated in FIG. 22, and the other end may be disposed on the extension portion 150 of the body 100, as illustrated in FIG. 23. When the extension portion 173' is disposed out of the side wall 130 or the extension portion 150, an accident may happen due to the sharp extension portion 173'.

The extension portion 173' may have a bent portion 173*a'*. The bent portion 173*a'* is formed at a middle portion of the extension portion 173'. Specifically, the bent portion 173*a'* may be formed by bending a portion of the plate-shape extension portion 173' toward the side wall 130 of the body.

The bent portion 173*a'* may be a single-bent portion, as illustrated in FIGS. 21 to 24, but the application is not limited thereto. The bent portion 173*a'* may be formed by bending the portion at least twice. Also, the bent portion 173*a'* may not be formed in an angular shape, but be formed in a round shape, differently from that shown in FIGS. 21 to 24. In addition, a plurality of rounded portions may be provided.

The extension portion 173' may be divided into two parts, with the bent portion 173*a'* being interposed therebetween. A first portion 173*b'* is a portion between the connection portion 171' and the bent portion 173*a'*, while a second portion 173*c'* may be a portion between the bent portion 173*a'* and the end of the extension portion 173'.

The first portion 173*b*' and the second portion 173*c*' may have a different shape. Specifically, the first portion 173*b*' may be a curved plate which is bent in a circular shape to have a desired curvature, while the second portion 173*c*' may be a flat plate with not curvature.

The curvature of the first portion 173*b*' is equal to or larger than that of the side wall 130' of the body 100. When the curvature of the first portion 173*b*' is equal to or larger than that of the side wall 130' of the body 100, when the bent portion 173*a*' abuts against the side wall 130' of the body 100, the bent portion 173*a* supports the second portion 173*c*'. When the second portion 173*c*' is supported by the bent portion 173*a*', the lighting device according to the third embodiment can be firmly fixed in the outer fixture 1000 shown in FIG. 6, which will be described in detail with reference to FIG. 25.

FIG. 25 is a plan view illustrating the case where the lighting device in FIG. 21 is installed to the inside of the outer fixture 1000.

Referring to FIGS. 24 and 25, since the curvature of the first portion 173*b*' of the extension portion 173' is larger than that of the side wall 130, when the lighting device according to the third embodiment is installed to the inside of the outer fixture 1000, the bent portion 173*a*' abuts against the side wall 130. Accordingly, since the second portion 173*c*' of the extension portion 173' is supported by the inner surface 1100 of the outer fixture 1000 and the bent portion 173*a*' at both ends, the lighting device according to the third embodiment can be firmly fixed to the inside of the outer fixture 1000. In case where the curvature of the first portion 173*b*' of the extension portion 173' is equal to that of the side wall 130, the same effect can be obtained.

Referring again to FIG. 24, the bent portion 173*a*' may be disposed in the range of a point of dividing both ends of the clip 170' into 6 to 4, and a point of dividing both ends into a ratio of 8 to 2. When the bent portion 173*a*' is disposed out of the range the point of dividing both ends of the clip 170' into the ratio of 6 to 4, and the point of dividing both ends into the ratio of 8 to 2, it is difficult to install the lighting device according to the third embodiment to the inside of the outer fixture 1000 shown in FIG. 25, and it is not possible to obtain a fixing force of a specific value or more in order to fix the lighting device according to the third embodiment to the inside of the outer fixture 1000. More preferably, the bent portion 173*a*' may be disposed at a point of dividing both ends of the clip 170' into a ratio of 7 to 3.

A bent angle v of the bent portion 173*a*' may be in the range of 147 degrees and 157 degrees.

When the bent angle v is within the range, even though the clip 170' is installed to the outer fixture 1000 shown in FIG. 25 and is bent, the edge of one end of the clip 170' is fixed at a proper position of the inner surface 1100 of the outer fixture 1000, thereby lowering the dropping risk of the lighting device.

However, when the bent angle v is out of the range, the edge of one end of the clip 170' is caught by the inner surface 1100 of the outer fixture 1000 shown in FIG. 25, and the side between two edges abuts against the inner surface of the outer fixture 1000, thereby increasing the dropping risk of the lighting device.

Fourth Embodiment

FIG. 26 is a perspective view of a lighting device according to the fourth embodiment when seen from a top. FIG. 27 is a perspective view of the lighting device in FIG. 26 when seen from a bottom. FIG. 28 is an exploded perspective view of the lighting device in FIG. 26. FIG. 29 is an exploded perspective view of the lighting device in FIG. 27. FIG. 30 is a cross-sectional view of the lighting device in FIG. 26.

The lighting device according to the fourth embodiment shown in FIGS. 26 to 30 is substantially identical to the lighting device according to the first embodiment shown in FIGS. 1 to 5, except for some components. Hereinafter, the same component in the lighting device according to the fourth embodiment shown in FIGS. 26 to 30 as those in the lighting device according to the first embodiment shown in FIGS. 1 to 5 are indicated by the same reference numerals, and the detailed description thereof will be omitted herein.

Referring to FIGS. 26 to 30, a body 100" may have a base 110", a side wall 130', and an extension portion 150.

The base 110 may be formed with a hole 117. A plurality of holes 117 may be formed in the base 110". The fastening member B, for example, a screw or a rivet, inserted in the guide groove 215 formed on the substrate 210 of the light source 200 may be engaged to the hole 117.

The side wall 130' may have a first side wall 131', a first connection portion 133', a second connection portion 135', and a second side wall 137'.

The first side wall 131' is disposed below the base 110". Specifically, an upper end of the first side wall 131' is connected to the base 110". The first side wall 131' form an obtuse angle to a bottom surface of the base 110".

The first wall 131' may have an outer surface and an inner surface 131*a*'. The inner wall 131*a*' of the first side wall 131' may be a reflective surface for reflecting the light emitting from the light emitting element 230 of the light source 200 which is disposed on the bottom surface of the base 110". The inner surface 131*a*' may be made of a light reflecting material or be coated by a light reflecting material. Also, the reflective sheet 370 may be disposed on the inner surface 131*a*' of the first side wall 131'.

Since the first side wall 131' has the reflective surface 131*a*', there is no reflective member 300 for the lighting device according to the first embodiment shown in FIGS. 1 to 5. Accordingly, it is possible to reduce manufacturing costs of the lighting device according to the fourth embodiment.

The first connection portion 133' is disposed below the first side wall 131'. Specifically, the first connection portion 133' may be connected to the lower end of the first side wall 131'. The first connection portion 133' may be extended outwardly from the lower end of the first side wall 131'.

The first connection portion 133' is connected to the second connection portion 135'. The first connection portion 133' may be formed with a plurality of holes 133*a*' so as to be connected to the second connection portion 135'. Fastening members (not shown, such as a screw or rivet, inserted into guiders 135*a*' of the second connection portion 135' and holes 135*b*' of the second connection portion 135' can be inserted into the holes 133*a'*.

The first side wall 131' and the first connection portion 133' may be formed integrally, but the application is not limited thereto. The first side wall 131' and the first connection portion 133' may be separately fabricated and engaged to each other.

The second connection portion 135' is disposed below the first connection portion 133', and the second connection portion 135' is engaged to the first connection portion 133'. The second connection portion 135' may be extended from the upper end of the second side wall 137' toward the inside of the second side wall 137'.

The second connection portion 135' may have the guider 135*a*'. The guider 135*a*' may protrude upwardly from the top surface of the second connection portion 135'. A plurality of guiders 135*a*' may be provided. The guider 135*a*' is connected to the hole 133*a*' of the first connection portion 133'. When the guider 135*a*' is connected to the hole 133*a*', the first side wall 131' and the second side wall 137' can be engaged to each other at the correct position and in the correct direction.

The second connection portion 135' may be formed with the hole 135*b*'. The hole 135*b*' may be positioned between two guiders 135*a*'. A fastening member (not shown), such as a screw or a rivet, is inserted into the hole 135*b*'. The fastening member is inserted into the hole 135*b*' and the hole 133*a*' of the first connection portion 133', thereby firmly engaging the first side wall 131' and the second side wall 137'.

The optical plate 410 is disposed on the second connection portion 135'. Specifically, as illustrated in FIG. 30, the second connection portion 135' supports the edge of the optical plate 410. The first connection portion 133' may be disposed on the optical plate 410. Specifically, the first connection portion 133' is disposed on the edge of the optical plate 410. Accordingly, the optical plate 410 is fixed between the first connection portion 133' and the second connection portion 135'.

The second side wall 137' is disposed below the first side wall 133', and is disposed below the second connection portion 135'. The second side wall 137' may be extended downwardly from the edge of the second connection portion 135'. A slope of the second side wall 137' relative to the bottom surface of the base 110" is different from that of the first side wall 131' relative to the bottom surface of the base 110". Specifically, the slope of the second side wall 137' relative to the bottom surface of the base 110" may be smaller than that of the first side wall 131'. When the slope of the second side wall 137' is equal to or larger than that of the side wall 131', since a size of the side wall 130' of the body 100" is increased, it is difficult to install the lighting device to the inside of the outer fixture 1000. Accordingly, it is preferable that the slope of the second side wall 137' is smaller than that of the first side wall 131'.

The cover 700' may have a base 710 having a pin 750 and a side wall 730 disposed below the base 710. The base 710 may be formed integrally with the side wall 730.

The side wall 730 may be engaged to the body 100". Specifically, the side wall 730 has a hole 731 in the inner surface thereof, and the fastening member B inserted into the hole 117 formed in the base 119" of the body 100" is inserted into the hole 731. The cover 700' and the body 100" can be engaged to each other by the fastening member B, the hole 117 of the base 110", and the hole 731 of the side wall 730.

The cover 700' may have a clip 770. The clip 770 is disposed on the side wall 730 of the cover 700'. Specifically, the clip 770 is connected to the side wall 730 of the cover 700'.

The clip 770 has the same configuration as the clip 170' shown in FIG. 24, but is disposed at the different position. Specifically, the clip 170' shown in FIG. 24 is connected to the side wall 130 of the body 100', but the clip 770 is connected to the side wall 730 of the cover 700'. Since the configuration of the clip 770 is substantially identical to that of the clip 170' shown in FIG. 24, except for the disposed position, the detailed description of the clip 770 will be omitted, in view of the description of the clip 170' shown in FIGS. 21 to 25.

The lighting device according to the fourth embodiment shown in FIGS. 26 to 30 has an advantage in that since the reflector 310 of the reflective member 300 of the lighting device shown in FIGS. 1 to 5 is applied to the first side wall 131' of the body 100", the material costs are reduced. Also, the lighting device can be fixed to the outer fixture 100 shown in FIG. 6 by the clip 770.

While the application has been described with reference to the particular illustrative embodiments, it is not to be restricted by the embodiments but only by the appended claims. It is to be appreciated that those skilled in the art can change or modify the embodiments without departing from the scope and spirit of the application.

The invention claimed is:

1. A lighting device comprising:

a body;

a reflective member;

a light source which is disposed below the body and is disposed on the reflective member; and a fixing member which is disposed on the body, and includes a base portion, wherein the base portion of the fixing member having at least one clip fixing shaft and at least one protrusion, wherein the fixing member including a clip which is engaged to the clip fixing shaft so as to be able to rotate, and crosses over the protrusion when rotation, wherein, when the clip crosses over the protrusion, movement of the clip being restricted by the protrusion, wherein the reflective member includes a reflector for reflecting light emitting from the light source, and a reflective sheet disposed on the reflector, wherein the reflective sheet is formed in a ring shape having both ends, and wherein one end of the reflective sheet has a connecting portion, and the other end of the reflective sheet has a connecting hole to which the connecting portion is connected.

2. The lighting device according to claim 1, wherein the protrusion protrudes upwardly from a top surface of the base portion of the fixing member, and wherein a top surface of the protrusion has two inclined surfaces which are convex in a downward direction.

3. A lighting device comprising:

a body;

a reflective member;

a light source which is disposed below the body and is disposed on the reflective member; and a fixing member which is disposed on the body, and includes a base portion, wherein the base portion of the fixing member having at least one clip fixing shaft and at least one protrusion, wherein the fixing member including a clip which is engaged to the clip fixing shaft so as to be able to rotate, and crosses over the protrusion when rotation, wherein, when the clip crosses over the protrusion, movement of the clip being restricted by the protrusion, wherein the clip has a center portion disposed on the clip fixing shaft, and both ends positioned at both sides of the center portion, wherein one end is disposed in the fixing member, and at least a portion of the other end is disposed out of the fixing member, and wherein, when the center portion of the clip rotates around the clip fixing shaft, the one end of the clip moves on the protrusion, and the other end of the clip is away from or close to the fixing member.

4. The lighting device according to claim 3, wherein the fixing member further includes a resilient member which is engaged to the clip fixing shaft to provide a resilient force so that the other end of the clip is maintained to be very close to the fixing member.

5. The lighting device according to claim 4, wherein the resilient member is a torsion spring having a coil portion and first and second ends connected to the coil, and wherein the coil portion is engaged to the clip fixing shaft, the first end is engaged to the one end of the clip, and the second end is disposed on the fixing member.

6. The lighting device according to claim 3, wherein the fixing member further includes a lateral portion to enclose the base portion of the fixing member, and wherein the lateral portion of the fixing member has a clip guide, on which the clip is disposed, and a guide groove in or away from which the other end of the clip comes.

7. The lighting device according to claim 3, wherein the other end of the clip further has a tap protruding outwardly from the other end of the clip.

8. The lighting device according to claim 3, wherein the other end of the clip is inclined downwardly from the center portion of the clip.

9. The lighting device according to claim 3, wherein the body includes a base disposed below the base portion of the fixing member, a side wall disposed below the base of the body, and an extension portion extending outwardly from a lower end of the side wall, and wherein the other end of the clip is disposed on the extension portion.

* * * * *